US007410057B2

(12) United States Patent
Yoshifusa

(10) Patent No.: US 7,410,057 B2
(45) Date of Patent: Aug. 12, 2008

(54) STRUCTURE OF AIR-PACKING DEVICE

(75) Inventor: Kark K. Yoshifusa, Lake Forest, CA (US)

(73) Assignee: AIR-PAQ, Inc., Lake Forest, CA (US)

( * ) Notice: Subject to any disclaimer, the term of this patent is extended or adjusted under 35 U.S.C. 154(b) by 0 days.

(21) Appl. No.: 11/220,755

(22) Filed: Sep. 7, 2005

(65) Prior Publication Data

US 2007/0051655 A1 Mar. 8, 2007

(51) Int. Cl.
*B65D 30/00* (2006.01)

(52) U.S. Cl. ..... 206/522; 383/3

(58) Field of Classification Search ..... 206/521, 206/522, 591, 592, 593, 594; 383/3, 38, 383/39, 40
See application file for complete search history.

(56) References Cited

U.S. PATENT DOCUMENTS 4,569,082 A * 2/1986 Ainsworth et al. ..... 383/3
5,469,966 A 11/1995 Boyer
5,826,723 A 10/1998 Jaszai
6,520,333 B1 * 2/2003 Tschantz ..... 206/522
6,629,777 B2 10/2003 Tanaka et al.
6,755,568 B2 * 6/2004 Malone et al. ..... 383/3
2004/0149618 A1 * 8/2004 Otaki et al. ..... 206/521
2005/0006271 A1 * 1/2005 Nakagawa ..... 206/521
2006/0032779 A1 * 2/2006 Tanaka et al. ..... 206/522
2007/0003170 A1 * 1/2007 Yoshida ..... 383/3

* cited by examiner

*Primary Examiner*—Davie T. Fidei
(74) *Attorney, Agent, or Firm*—Finnegan, Henderson, Farabow, Garrett & Dunner, LLP

(57) ABSTRACT

An air-packing device has an improved shock absorbing capability to protect a product in a container box. The air-packing device is comprised of an enclosure portion that surrounds and supports a pocket portion that holds a product to be protected such that the pocket portion does not contact the ground when shocks are applied to the air-packing device. Each of the enclosure portion and the pocket portion is configured by first and second thermoplastic films which are bonded at predetermined portions thereby creating a plurality of air containers. Each of the air containers has a check valve for allowing the compressed air to flow only in a forward direction.

19 Claims, 20 Drawing Sheets

STRUCTURE OF AIR-PACKING DEVICE

FIELD OF THE INVENTION

This invention relates to a structure of an air-packing device for use as packing material, and more particularly, to a structure of an air-packing device and check valves incorporated therein for achieving an improved shock absorbing capability to protect a product from a shock or impact by a pocket portion that is supported by surrounding an enclosure portion such that the pocket portion does not contact the ground when shocks are applied to the air-packing device.

BACKGROUND OF THE INVENTION

In product distribution channels such as product shipping, a Styrofoam packing material has been used for a long time for packing commodity and industrial products. Although the styrofoam package material has a merit such as a good thermal insulation performance and a light weight, it has also various disadvantages: recycling the styrofoam is not possible, soot is produced when it burns, a flake or chip comes off when it is snagged because of it's brittleness, an expensive mold is needed for its production, and a relatively large warehouse is necessary to store it.

Therefore, to solve such problems noted above, other packing materials and methods have been proposed. One method is a fluid container of sealingly containing a liquid or gas such as air (hereafter also referred to as an "air-packing device"). The air-packing device has excellent characteristics to solve the problems involved in the styrofoam. First, because the air-packing device is made of only thin sheets of plastic films, it does not need a large warehouse to store it unless the air-packing device is inflated. Second, a mold is not necessary for its production because of its simple structure. Third, the air-packing device does not produce a chip or dust which may have adverse effects on precision products. Also, recyclable materials can be used for the films forming the air-packing device. Further, the air-packing device can be produced with low cost and transported with low cost.

FIG. 1 shows an example of structure of an air-packing device in the conventional technology. The air-packing device 20 includes a plurality of air containers 22 and check valves 24, a guide passage 21 and an air input 25. The air from the air input 25 is supplied to the air containers 22 through the air passage 21 and the check valves 24. Typically, the air-packing device 20 is composed of two thermoplastic films which are bonded together at bonding areas 23*a*.

Each air container 22 is provided with a check valve 24. One of the purposes of having multiple air containers with corresponding check valves is to increase the reliability, because each air container is independent from the others. Namely, even if one of the air containers suffers from an air leakage for some reason, the air-packing device can still function as a shock absorber for packing the product because other air containers are still inflated because of the corresponding check valves.

FIG. 2 is a plan view of the air-packing device 20 of FIG. 1 when it is not inflated which shows bonding areas for closing two thermoplastic films. The thermoplastic films of the air-packing device 20 are bonded (heat-sealed) together at bonding areas 23*a* which are rectangular periphery thereof to air tightly close the air-packing device 20. The thermoplastic films of the air-packing device 20 are also bonded together at bonding areas 23*b* which are boundaries of the air containers 22 to air-tightly separate the air containers 22 from one another.

When using the air-packing device, each air container 22 is filled with the air from the air input 25 through the guide passage 21 and the check valve 24. After filling the air, the expansion of each air container 22 is maintained because each check-valve 24 prevents the reverse flow of the air. The check valve 24 is typically made of two small thermoplastic films which are bonded together to form an air pipe. The air pipe has a tip opening and a valve body to allow the air flowing in the forward direction through the air pipe from the tip opening but the valve body prevents the air flow in the backward direction.

Air-packing devices are becoming more and more popular because of the advantages noted above. There is an increasing need to store and carry precision products or articles which are sensitive to shocks and impacts often involved in shipment of the products. There are many other types of product, such as wine bottles, DVD drivers, music instruments, glass or ceramic wares, antiques, etc. that need special attention so as not to receive a shock, vibration or other mechanical impact. Thus, it is desired that the air-packing device protects the product to minimize the shock and impact.

SUMMARY OF THE INVENTION

It is, therefore, an object of the present invention to provide a structure of an air-packing device for packing a product that can minimize a mechanical shock or vibration to the product.

It is another object of the present invention to provide a structure of a check valve for the air-packing device that can reliably prevent reverse flow of the air in the air containers of the air-packing device.

In one aspect of the present invention, an air-packing device inflatable by compressed air for protecting a product therein when stored in a container box, comprising a pocket portion having an upper sheet portion and a lower sheet portion to create an opening into which the product is inserted, each of the upper sheet portion and the lower sheet portion having a plurality of air containers, an enclosure portion having a plurality of air containers and configuring walls that surround the pocket portion therein. The pocket portion is supported by the enclosure portion at about an intermediate height of the enclosure portion such that the product in the pocket portion will not contact with a bottom or top of the container box when shocks are applied to the air-packing device. Each of the air containers of the pocket portion and the enclosure portion has a check valve for allowing air to flow in a forward direction while preventing the air from flowing in a reverse direction.

Each air container of the enclosure portion has a multiplicity of air cells serially connected with one another thereby allowing the air to flow through the air cells of the same air container. Each air cell is separated from the other air cells on the same air container by a heat-seal land at which thermoplastic films forming the air-packing device are heat-sealed. The air flows through a passage created on a side of the heat-seal land toward the next air cell on the same air container. The heat-seal lands on the air container function as folding points of the walls of the enclosure portion.

Each of the pocket portion and the enclosure portion is comprised of first and second thermoplastic films superposed with each other where predetermined portions of the first and second thermoplastic films are bonded, thereby creating the plurality of air containers, and wherein the check valves are established between the first and second thermoplastic films. An air input is commonly connected to the plurality of check valves to supply the compressed air to all of the air container.

At least two side edges of the pocket portion are attached to the enclosure portion in such a manner that each side edge is heat-sealed to an area which is a boundary between two adjacent air containers of the enclosure portion through a post heat-seal treatment. Edges of an upper sheet portion of the pocket portion are attached to the enclosure portion where each edge is heat-sealed to an area between two adjacent air containers, and edges of a lower sheet portion of the pocket portion are attached to the enclosure portion where each edge is heat-sealed to the same area between two air containers where the corresponding edge of the upper sheet portion is attached. Alternatively, edges of an upper sheet portion of the pocket portion are attached to the enclosure portion where each edge is heat-sealed to an area between two adjacent air containers, and edges of a lower sheet portion of the pocket portion are attached to the enclosure portion where each edge is heat-sealed to an area between two air containers which is vertically different from the area where the corresponding edge of the upper sheet portion is attached.

The check valve includes sealed portions which are fixed to one of thermoplastic films configuring the air-packing device, where the sealed portions include an inlet portion which introduces the air into the check valve; a pair of narrow down portions creating a narrow down passage connected to the inlet portion; an extended portion which diverts the air flows coming through the narrow down passage; and a plurality of outlet portions which introduce the air from the extended portion to the air container.

Alternatively, the check valve is comprised of a check valve film on which peeling agents of predetermined pattern are printed, the check valve film being attached to one of first and second thermoplastic films configuring the air-packing device; an air input established by one of the peeling agents on the air-packing device for receiving an air from an air source; an air flow maze portion forming an air passage of a zig-zag shape, the air flow maze portion having an exit at an end thereof for supplying the air from the air passage to a corresponding air container having one or more series connected air cells; and a common air duct portion which provides the air from the air input to the air flow maze portion of a current air container as well as to the air flow maze portion of a next air container having one or more series connected air cells; wherein heat-sealing between the first and second thermoplastic films for separating two adjacent air containers is prevented in a range where the peeling agent is printed.

According to the present invention, the air-packing device can minimize shocks or vibrations to the product when the product is dropped or collided. The sheet form of the air-packing device is folded and the post heat-seal treatment is applied thereto, thereby creating a structure unique to a production to be protected. The air-packing device is basically configured by the enclosure portion and the pocket portion. The enclosure portion is comprised of multiple rows of air containers. The pocket portion is formed at about the center of the enclosure portion. Consequently, even when a large shock or vibration is applied to the air-packing device, the pocket portion will not touch the ground. Further, since the pocket portion is flexibly moved when the shock is applied, it can effectively damp the shock to the product therein. The check valves in the air-packing device have a unique structure for preventing reverse flows of the air. The air-packing device of the present invention has a relatively simple structure with reliable check valves, thus, the present invention is able to provide a reliable air-packing device with low cost.

BRIEF DESCRIPTION OF THE DRAWINGS

FIG. 3A is a perspective view of the air-packing device where an enclosure portion and a pocket portion are not inflated, FIG. 3B is a perspective view where the enclosure portion is inflated while the pocket portion is not inflated, FIG. 3C is a perspective view where the product to be protected is inserted into the pocket portion of the air-packing device of FIG. 3B, FIG. 3D is a perspective view where the pocket portion is inflated after the package has been placed into the pocket portion, and FIG. 3E is a perspective view where the door of the enclosure portion has been bent to completely encircle the pocket portion.

FIG. 11A shows a cross sectional plan view of the check valve, FIG. 11B shows a cross sectional side view thereof, and FIG. 11C shows a cross sectional side view for explaining the operation of the check valve.

FIG. 12A is a plan view showing a structure of a check valve on an air-packing device, FIG. 12B is a plan view showing the check valve including flows of air when a compressed air is supplied thereto, FIG. 12C is a plan view showing the portions for bonding the check valve sheet to a thermoplastic film of the air-packing device, and FIG. 12D is a plan view showing the portions for bonding the check valve sheet and the two plastic films of the air-packing device.

FIG. 15A shows air flows in the air cells of the air-packing device when being inflated, and FIG. 15B shows a situation where the air-packing device is fully inflated and the check valve is closed.

DETAILED DESCRIPTION OF THE INVENTION

Figure 1:
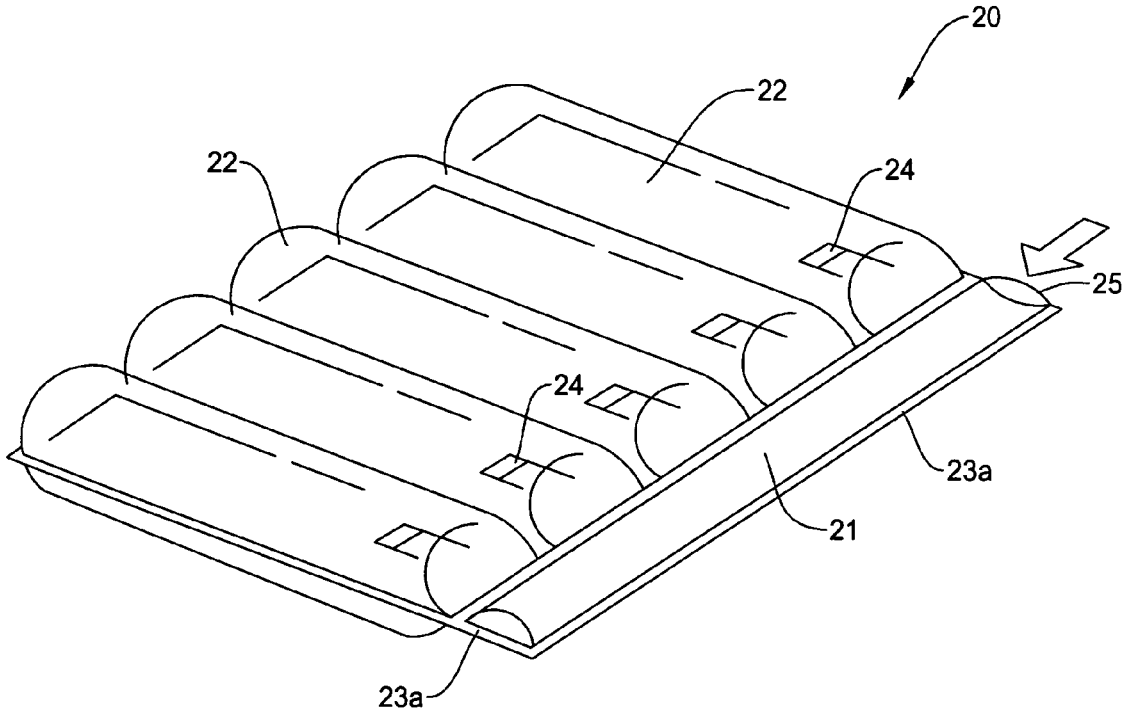
FIG. 1 is a schematic perspective view showing an example of basic structure of an air-packing device in the conventional technology.
Figure 2:
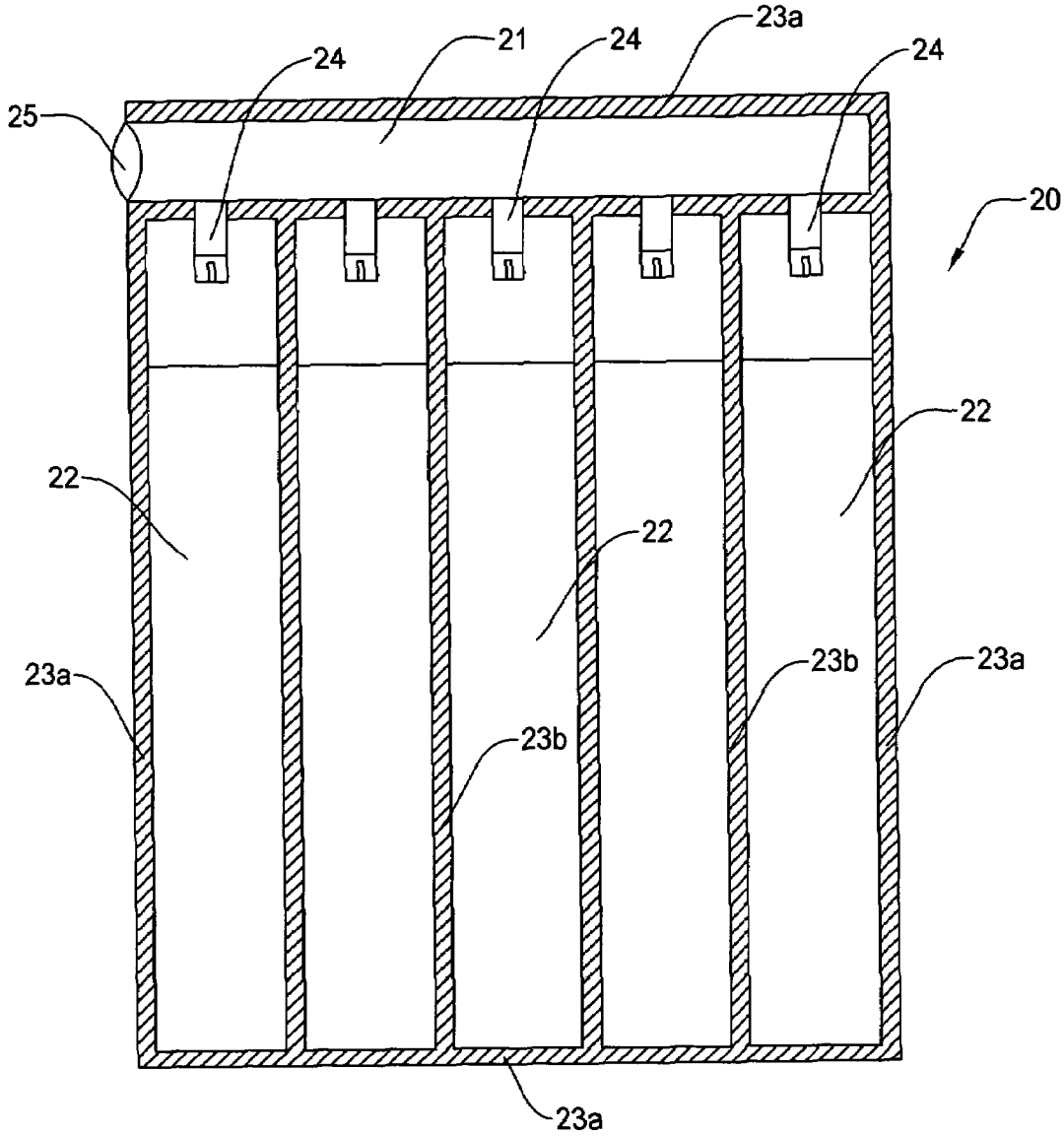
FIG. 2 is a plan view of the air-packing device 20 of FIG. 1 when it is not inflated for showing bonding areas for closing two thermoplastic films.

The air-packing device of the present invention will be described in more detail with reference to the accompanying drawings. It should be noted that although the present invention is described for the case of using an air for inflating the air-packing device for an illustration purpose, other fluids such as other types of gas or liquid can also be used. The air-packing device is typically used in a container box to pack a product during the distribution channel of the product.

The air-packing device of the present invention is especially useful for packing products which are sensitive to shock or vibration such as hard drives, personal computers, DVD drivers, etc. Other examples of such products include, but not limited to, bottles, glassware, ceramic ware, music instruments, paintings, antiques, etc. The air-packing device reliably wraps the product within a space created by folding and applying a post heat-sealing treatment, thereby absorbing the shocks and impacts to the product when, for example, the product is inadvertently dropped on the floor or collided with other objects.

The air-packing device of the present invention includes a plurality of air containers each having a plurality of serially connected air cells. The air container is air-tightly separated from the other air containers while the air cells in the same air container are connected by the air passages such that the air can flow freely among the air cells. Each air cell in the air container has a sausage like shape when the air is filled therein.

FIGS. 3A-3E are perspective views showing an example of structure of the air-packing device 201 in the present invention. FIGS. 3A-3E also show an example of procedure for packing a product to be protected in the air-packing device 201. A product 31 is shown which will be packed by the air-packing device 201 for protection from shocks and vibrations. Typically, the air-packing device is further packed in a container box made of hard paper, etc.

The air-packing device 201 is basically configured by an enclosure portion 199 and a pocket portion 155. The enclosure portion 199 is comprised of a pair of side portions 171, 175, a back portion 173, and a door portion 177, each of which is comprised of multiple rows of air containers 111. The pocket portion 155 is formed at about the center of the enclosure portion 199 with an opening at the door portion 177. When inflated, each portion of the enclosure portion 199 forms a wall-like structure so that the air-packing device 201 can stand up on a floor.

The air packing device 201 is made of two thermoplastic films which are bonded (heat-sealed) together to create the plurality of air containers 111. Such bonded areas are denoted by reference numerals 271 in FIGS. 3A-3E. In the enclosure portion 199, each air container 111 has a plurality of serially connected air cells 101. More specifically, the series connected air cells 101 are created by bonding (heat-sealing) the two thermoplastic films of the air container 111 at each small heat-seal land (separator) 103. Because the heat-seal land 103 does not completely separate the adjacent air cells 101, two small air passages (upper end and lower end of the heat-seal land) are created for flowing the air therethrough.

Typically, each air container 111 is provided with a check valve 291 so that the compressed air is maintained in the air container because the check valve 291 prohibits a reverse flow of the air. When the air is supplied, through an air input 295 and a common air passage 293, the air flows through the check valve 291 and inflates the air cells 101. In the air container 111, the air flows through the small passages at the upper and lower sides of the heat-seal lands 103 toward the last air cell 101 to inflate all of the air cells 101. Since the two thermoplastic films are bonded at the bonding areas 271 and the heat-seal lands 103, each air cell is shaped like a sausage when the air is filled in the air-packing device 201.

Figure 3A:
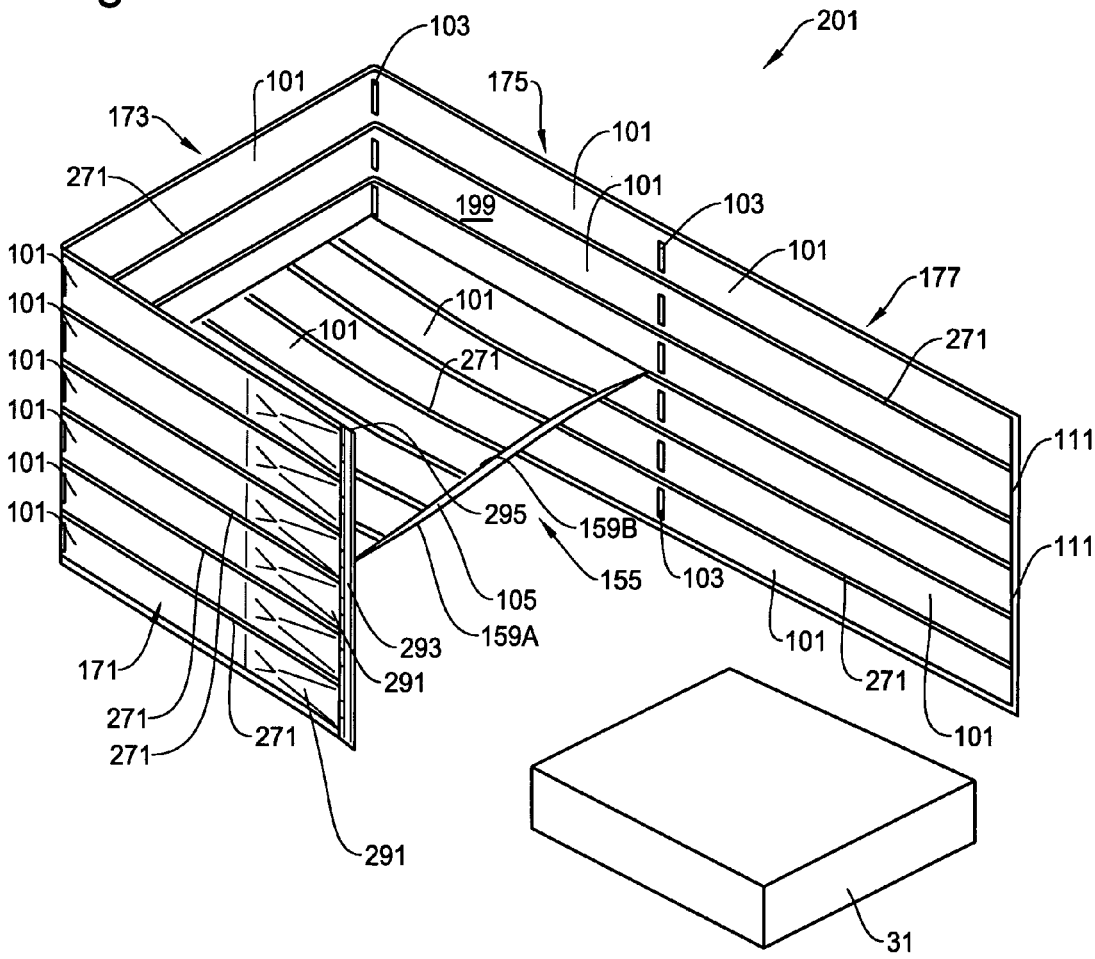
FIGS. 3A to 3E are perspective views showing an example of structure of the air-packing device under the present invention and a procedure of packing the product to be protected therein.

FIG. 3A is a perspective view of the air-packing device where the enclosure portion 199 and the pocket portion 155 are not inflated. The pocket portion 155 is formed of an upper pocket sheet 159A and a lower pocket sheet 159B, which creates a pocket opening 105. Each of the upper pocket sheet 159A and the lower pocket sheet 159B has a plurality of air cells 101 which will be inflated when the compressed air is supplied thereto. The product 31 to be protected will be inserted in the pocket portion 155 through the pocket opening 105. The door portion 177 of the enclosure portion 199 of the air-packing device 201 closes the pocket portion 155 after the product 31 is packed therein. Namely, the enclosure portion 199 serves to protect the product inside the pocket portion 155.

Figure 3B:
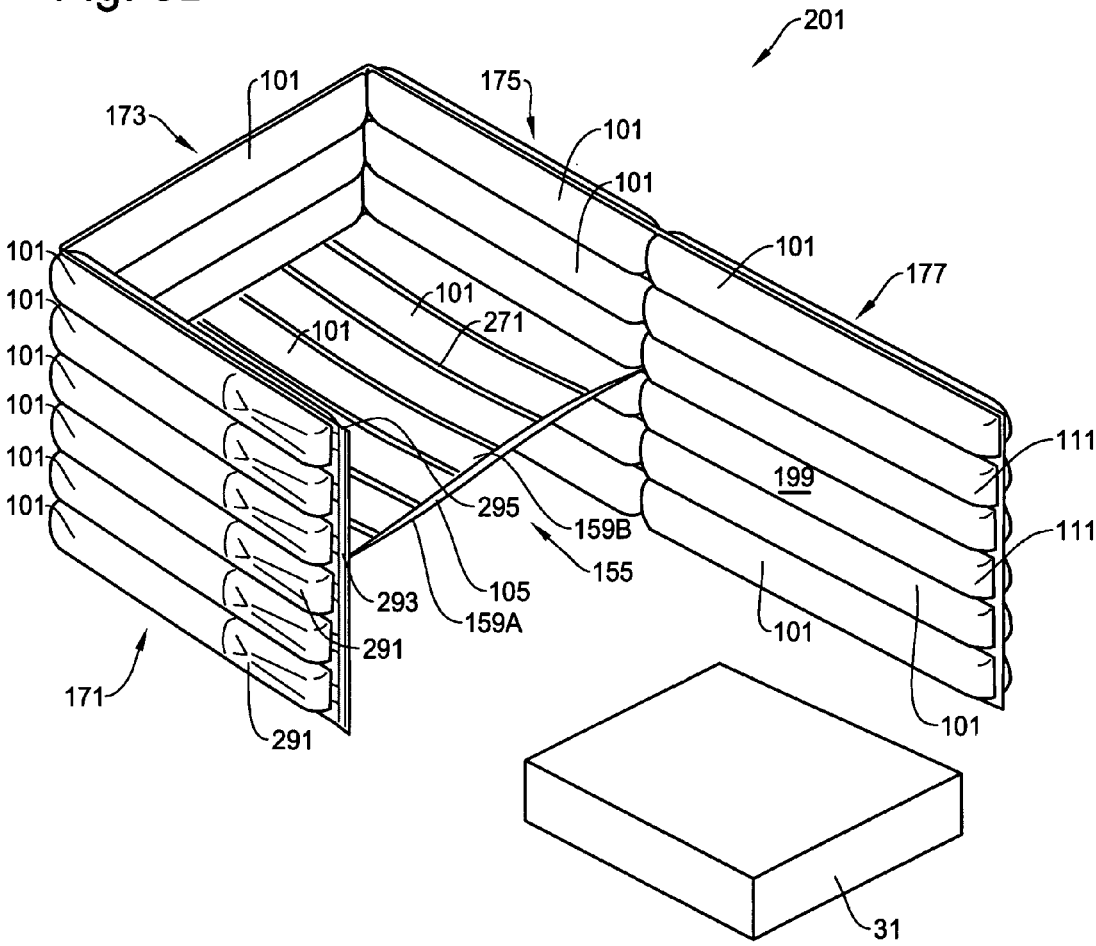

FIG. 3B is a perspective view of the air-packing device 201 where only the enclosure portion 199 is inflated while the pocket portion 155 is not inflated. In this example, as noted above, the compressed air is introduced from the air input 295 via the common air passage 293 to each of the air cells 101. As noted above, since the two thermoplastic films are bonded at each small heat-seal land 103, each air cell 101 is shaped like a sausage when the air is filled in the air-packing device 201. In other words, because the heat-seal lands 103 are not filled with the air, the air cells 101 can be easily bent at the heat-seal lands 103 to form the generally rectangular shape of the air-packing device 201.

Figure 3C:
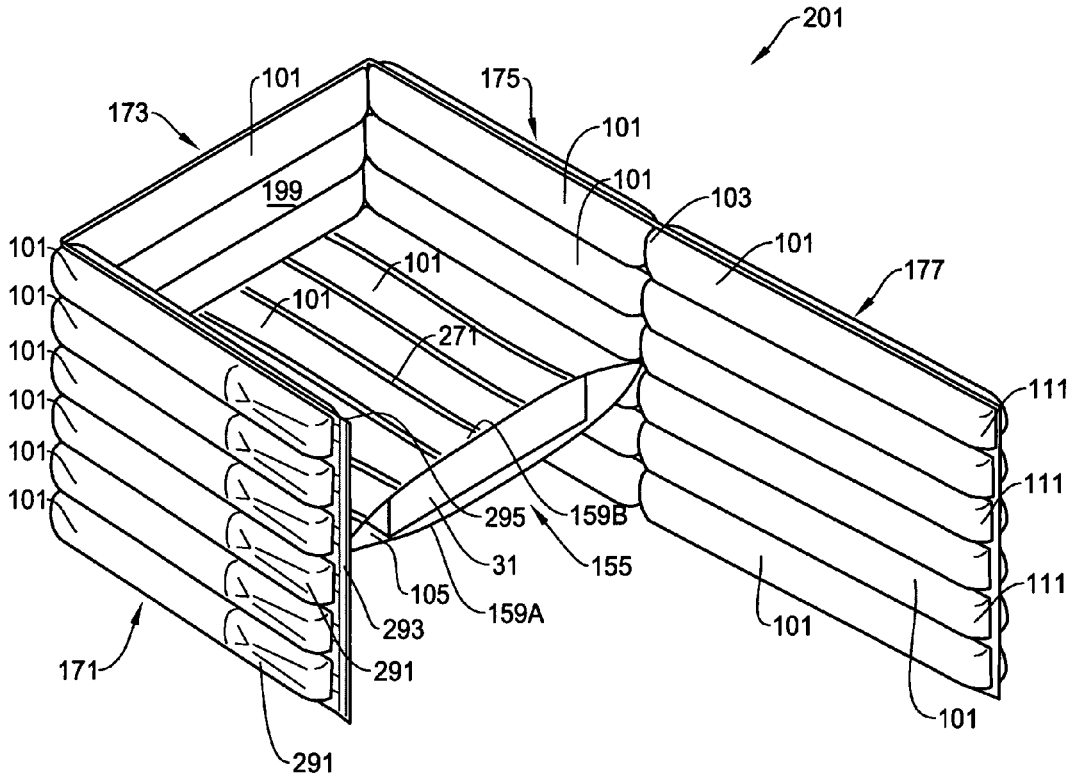

FIG. 3C is a perspective view of the air-packing device where the product 31 to be protected is inserted into the pocket portion 155. It is preferable to insert the product 31 before inflating the air-packing device because it is easier to do so. It is also possible to insert the product 31 after the pocket portion 155 is filled with the air, however, because the inner space is almost closed by the inflated air cells 101, it may be time consuming to insert the product 31 in the pocket portion. In this example, the product 31 has a box shape although other shapes and sizes are also possible due to the flexibility of the air inflation of the air-packing device 201.

Figure 3D:
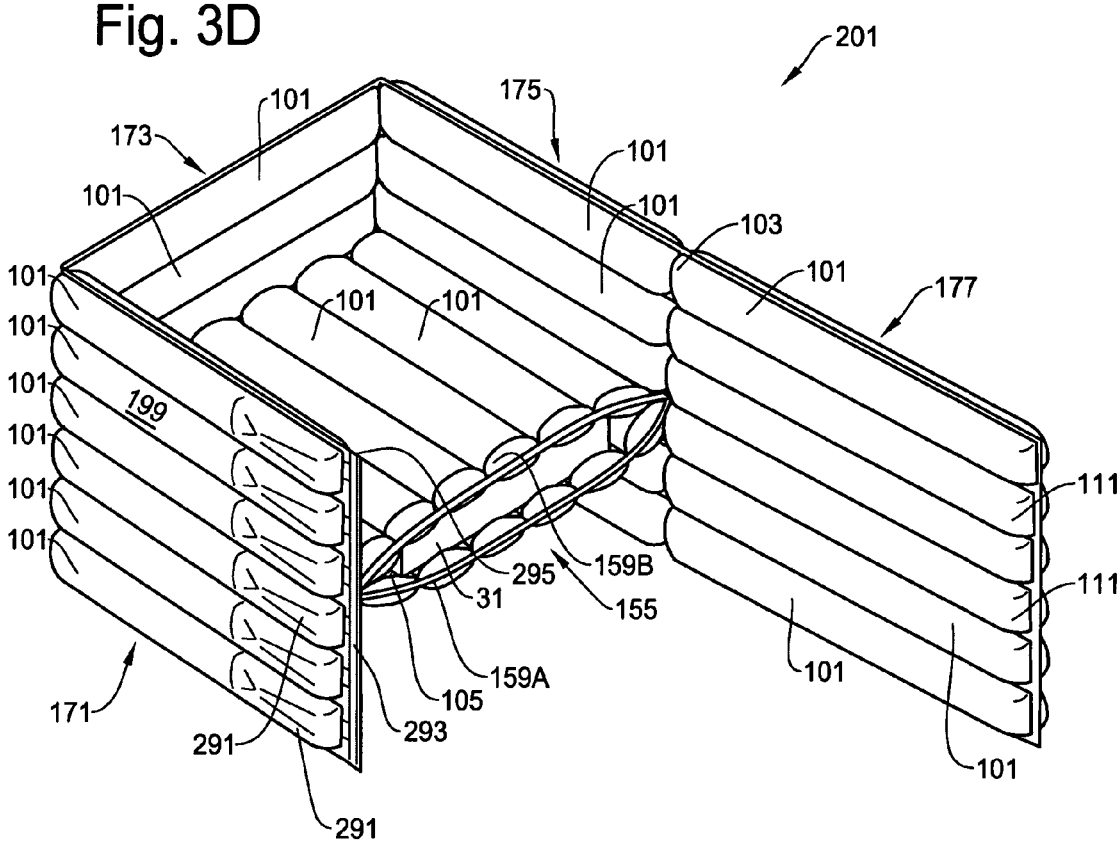
Figure 3E:
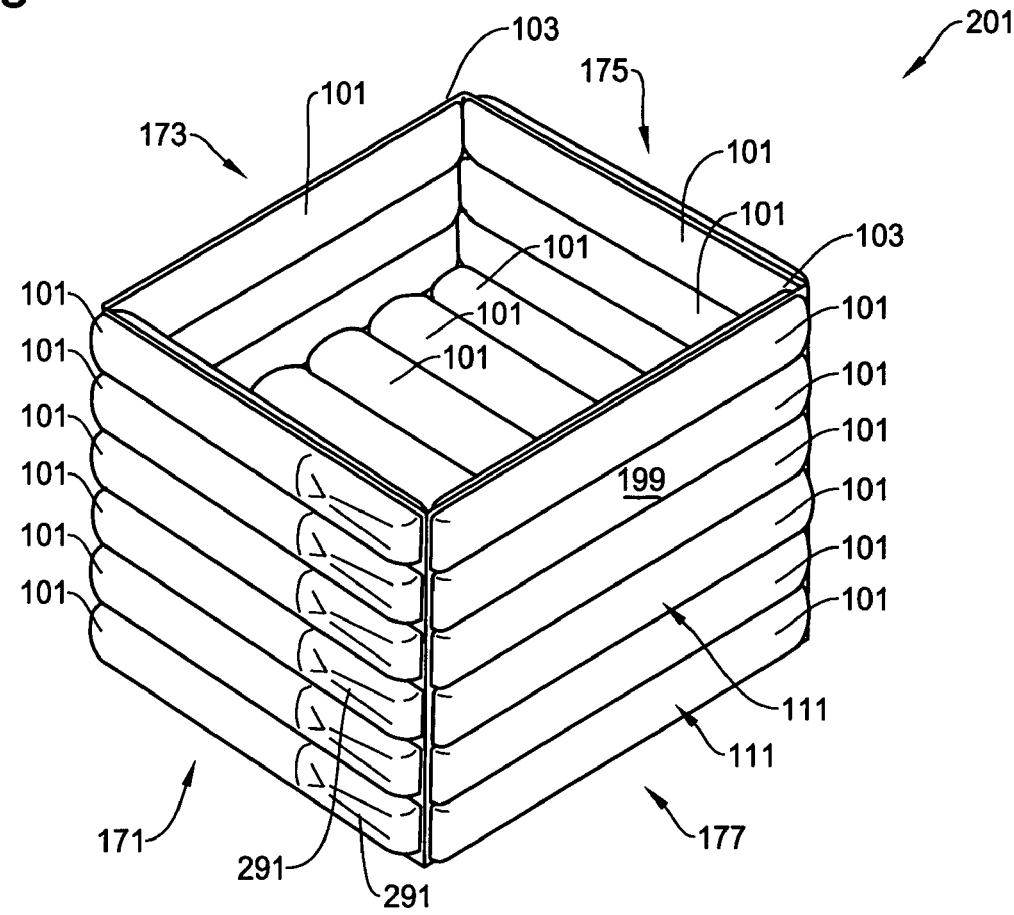

FIG. 3D is a perspective view of the air-packing device 201 where the pocket portion 155 is inflated after the product 31 has been placed therein. Because the pocket portion 155 is filled with the air, the product 31 is packed relatively tightly so that the product 31 cannot be freely moved. FIG. 3E is a perspective view of the air-packing device 201 where the door portion 177 of the enclosure portion 199 has been bent to completely encircle the pocket portion. The edge of the door portion 177 may be attached to the edge of the side portion 171 by an adhesive such as an adhesive tape. Typically, the air-packing device 201 having the product 31 therein as shown in FIG. 3E is placed in a container box (FIG. 4) such as a corrugated fiber box, a carton box, or the like.

As shown, the enclosure portion 199 protects the product 31 inside the air-packing device 201 from the shock and vibration in the horizontal direction. The product 31 inside the air-packing device 201 is held by the pocket portion 155 as if the package floats inside the air-packing device 201. The pocket portion 155 and the product 31 will not contact the floor, ground or other bottom surface when the shock or vibration is applied to the air-packing device 201. Thus, the shock or vibration received by the air-packing device 201 can be minimized for the product 31.

Figure 4:
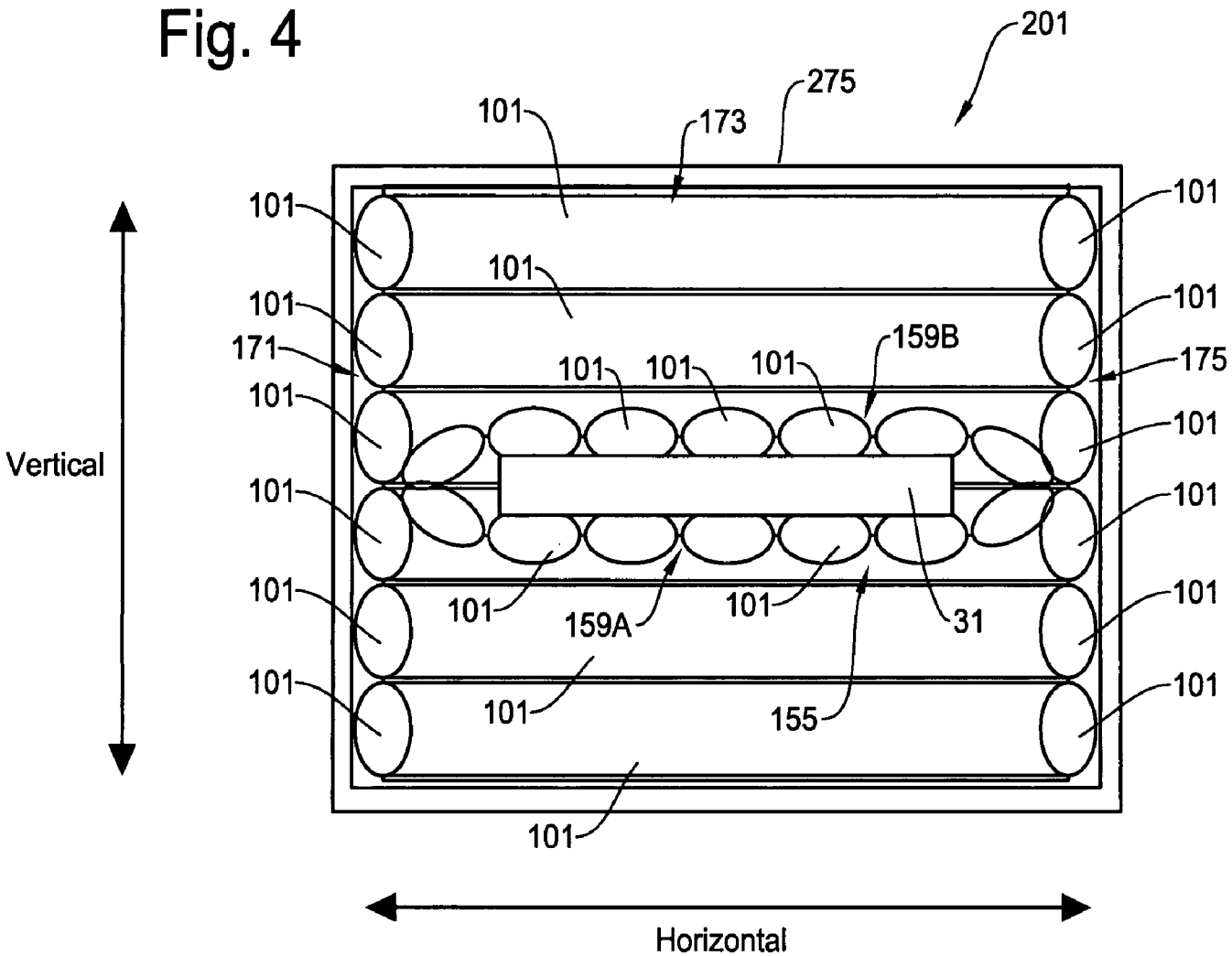
FIG. 4 is a cross sectional front view of the air-packing device for packing a product therein and is installed in a container box according to the present invention where the door portion is omitted.

FIG. 4 is a cross sectional front view showing the structure of the air-packing device 201 of the present invention. In this example, the air-packing device 201 is in a condition similar to that shown in FIG. 3D where the product 31 is inserted into the pocket portion 155 and both the enclosure portion 199 and the pocket portion 155 are filled with the air. For the sake of clarity, the door portion 177 is omitted in FIG. 4. As a typical example, the air-packing device 201 which packs the product 31 therein is placed in a container box 275.

The arrows in the left side indicate the vertical direction as used in the description of the present invention. Likewise, the arrows in the bottom indicate the horizontal direction as used in the description of the present invention. The horizontal direction is not limited to the direction between the side portions 171 and 175, but also includes the direction from the front (the side where the opening 105 of the pocket portion 155 faces) to the back (the side where-the back wall portion 173 is located). As shown, the product 31 is held in the pocket portion 155 is comprised of the upper sheet 159B and the lower sheet 159A each having a plurality of air cells 101.

The vertical position of the pocket portion 155 is determined by the size of the air cells 101 in the enclosure portion 199 as well as the number of air cells 101 aligned in the vertical direction. The clearance is formed between the bottom surface of the container box 275 and the lower surface of the pocket portion 155. Similarly, the clearance is formed between the top surface of the container box 275 and the upper surface of the pocket portion 155. Typically, the pocket portion 155 is formed at about the intermediate or center vertical position of the air-packing device 201 since the container box 275 may be up-side-down during the product distribution stage.

Such a clearance distance is preferably larger for a heavier product. Consequently, even when a large shock or vibration is applied to the container box 275 in the vertical direction, the pocket portion 155 will not touch the ground since the pocket portion 155 is attached to the seam of the enclosure portion 199 so as to float inside the enclosure portion 199. In other words, the pocket portion 155 is flexibly moved when the shock is applied, it can effectively damp the shock to the product 31 therein. Even if the pocket portion 155 contacts the ground because of the large impact, the air cells 101 of the pocket portion 155 serve as cushion to protect the product 31.

Figure 5A:
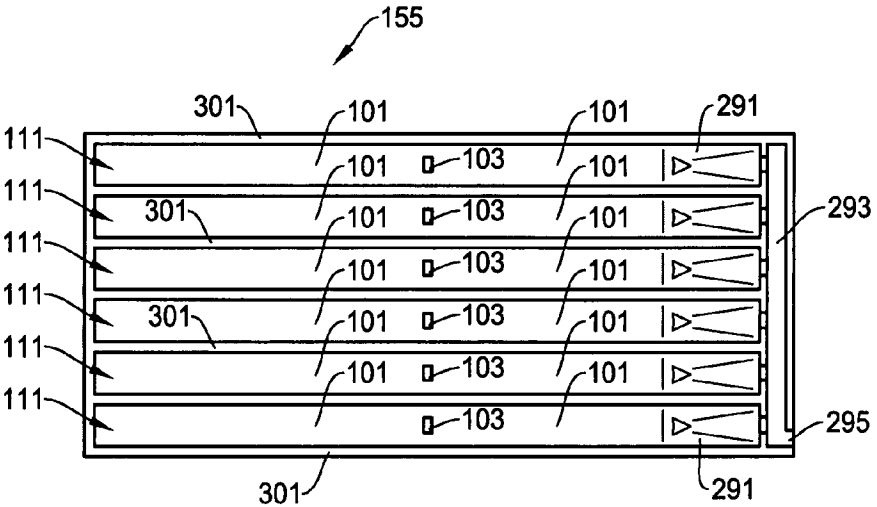
FIGS. 5A and 5B are schematic views showing an example of sheet like construction of the pocket portion of the air-packing device of the present invention before being attached to the enclosure portion.

Reference is now made to FIGS. 5A-8C showing a more detailed configuration of the air-packing device 201 in accordance with the present invention. FIGS. 5A and 5B show the structure of the pocket portion 155 of the air-packing device 201 when it is not filled with the air. Typically, the pocket portion 155 is produced separately from the enclosure portion 199 through a first heat-sealing process in which the two thermoplastic films are bonded at bonding areas 301 to create two or more air containers 111 and check valves 291. The pocket portion 155 is then attached to the enclosure portion 199 of the air-packing device 201 through a second heat-sealing process by bonding the edges to the enclosure portion 199.

FIG. 5A is a plan view showing a sheet-like structure of the pocket portion 155 of the air-packing device 201. The pocket portion 155 has sets of air containers 111 each having a check valve 291 and two air cells 101. An air input 295 is an opening into which compressed air is supplied from an air compressor. A common air passage 293 is connected to each air container so that the air introduced at the air input 295 is supplied to each and every air container 111. The check valves 291 for the corresponding air containers 111 prevent the reverse flow of the air. The two air cells 101 in each air container 111 are defined by a heat-seal land (separator) 103 at which the two thermoplastic films are bonded together.

Figure 5B:
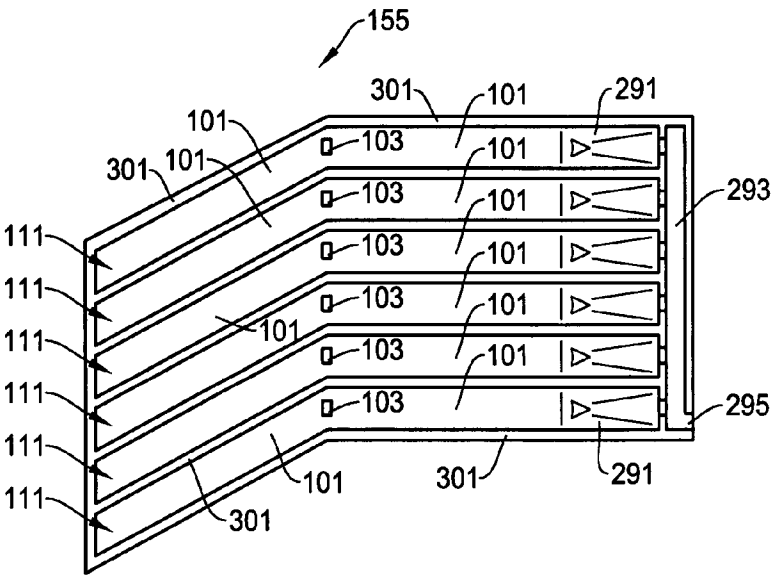

FIG. 5B is schematic view showing the pocket portion 155 of the air-packing device 201 that is bent at the heat-seal lands 103. Since the thermoplastic films at the heat-seal lands 103 are heat-sealed to one another, the heat-seal lands 103 are flat when the air is filled in the pocket portion 155. Therefore, the pocket portion 155 can be folded at the heat-seal lands 103. Because the heat-seal lands 103 do not entirely close the air container 111 but forms the small air passages at both sides within the air container 111, the air from the air input 295 flows toward the other end of the air container 111. When folded, one side of the pocket portion 155 becomes the upper sheet portion 159B and the other side becomes the lower sheet portion 159A shown in FIGS. 3A-3E and 4.

Figure 6A:
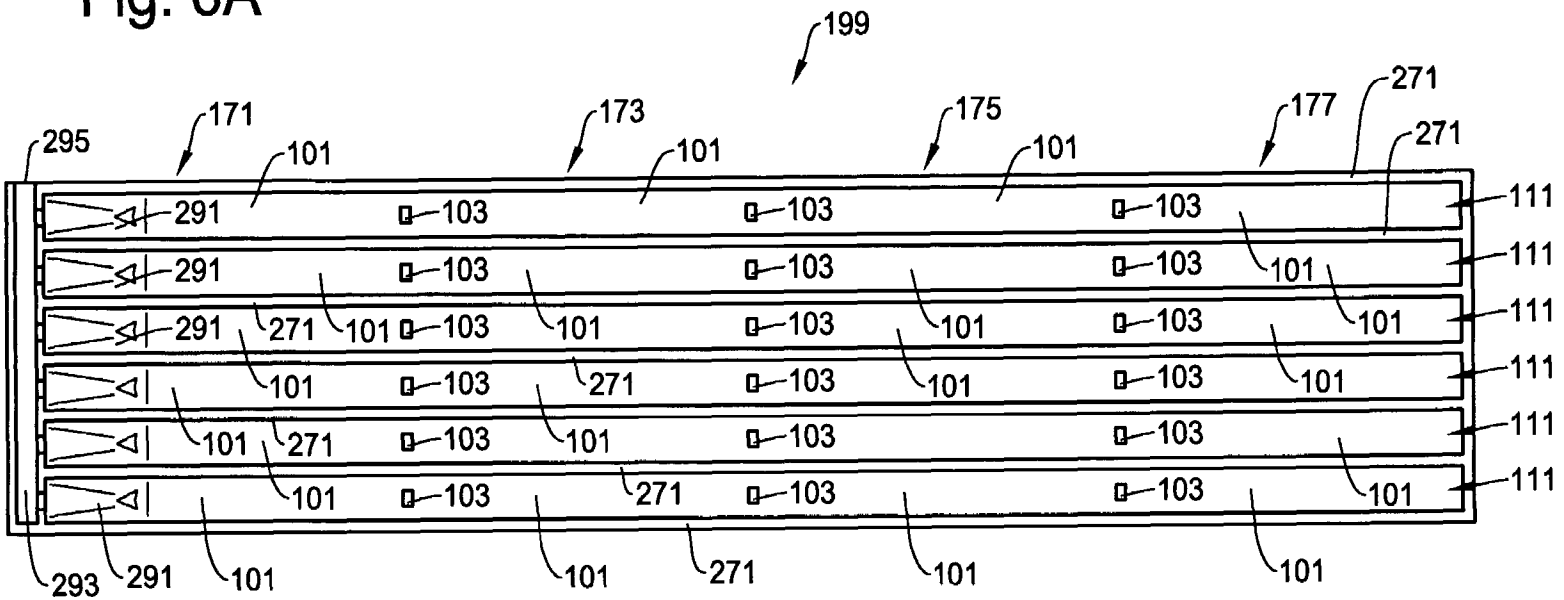
FIGS. 6A and 6B are schematic views showing an example of sheet like structure of the enclosure portion and the pocket portion of the air-packing device of the present invention before being attached to one another.
Figure 6B:
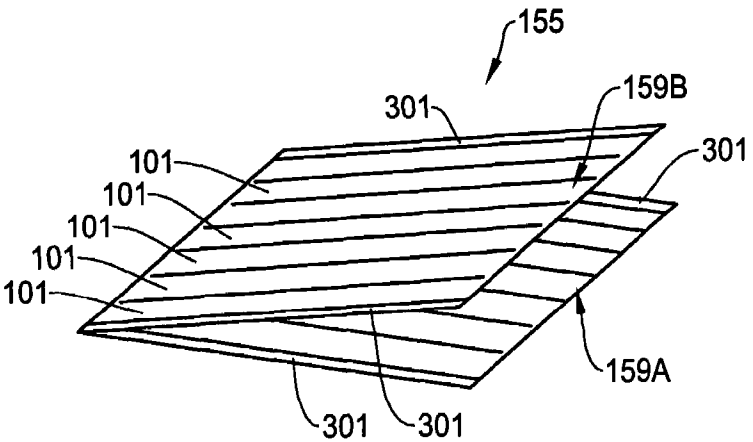

FIGS. 6A and 6B are schematic diagrams showing the enclosure portion 199 and the pocket portion 155, respectively, before being inflated by the air to explain the construction of the air-packing device 201. The enclosure portion 199 of FIG. 6A has a sheet-like structure when it is not inflated. Similar to the pocket portion 155 shown in FIGS. 5A and 5B, the enclosure portion 199 has a plurality of air containers 111 each having a check valve 291 and a plurality of series connected air cells 101. As noted above, the air containers 111 are created by heat-sealing the two thermoplastic films at bonding areas (separation seals) 271.

An air input 295 is an opening into which compressed air is supplied from an air compressor. A common air passage 293 connects each air container 111 so that the air introduced to the air input 295 is supplied to each and every air container 111. Each air container 111 has one check valve 291 which prevents the reverse flow of the air so that the air container 111 remains inflated after being filled with the air.

In FIG. 6B, the pocket portion 155 is folded at the heat-seal lands 103 as noted above with reference to FIGS. 5A and 5B. One side edge portion (bonding area) 301 of the pocket portion 155 is attached to the separation seal 271 of the enclosure portion 199 at about the middle of the side wall portion 175 through a heat-seal process. Similarly, the opposing side of the side edge portion (bonding area) 301 of the pocket portion 155 is attached to the separation seal 271 of the enclosure portion 199 at about the middle of the side wall portion 171. Therefore, the pocket portion 155 is formed at about the intermediate position of the enclosure portion 199 as shown in FIGS. 3A-3E.

Figure 7B:
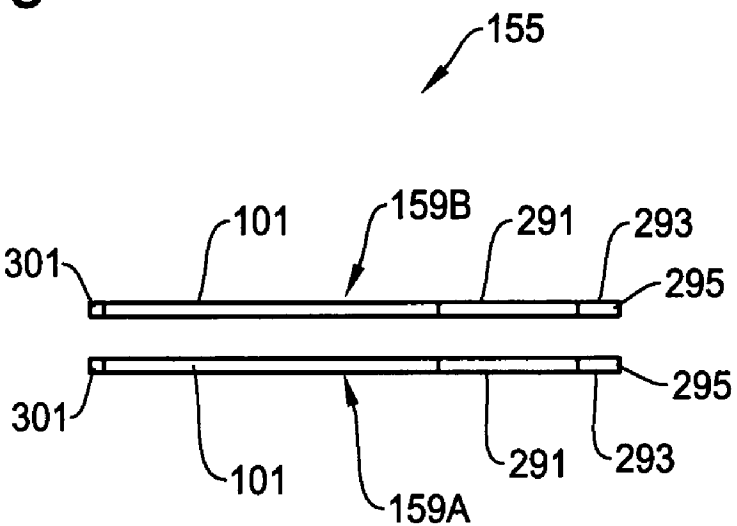
FIGS. 7A and 7B are schematic views showing another example of sheet like structure of the pocket portion of the air-packing device in the present invention before being attached to the enclosure portion.
Figure 7A:
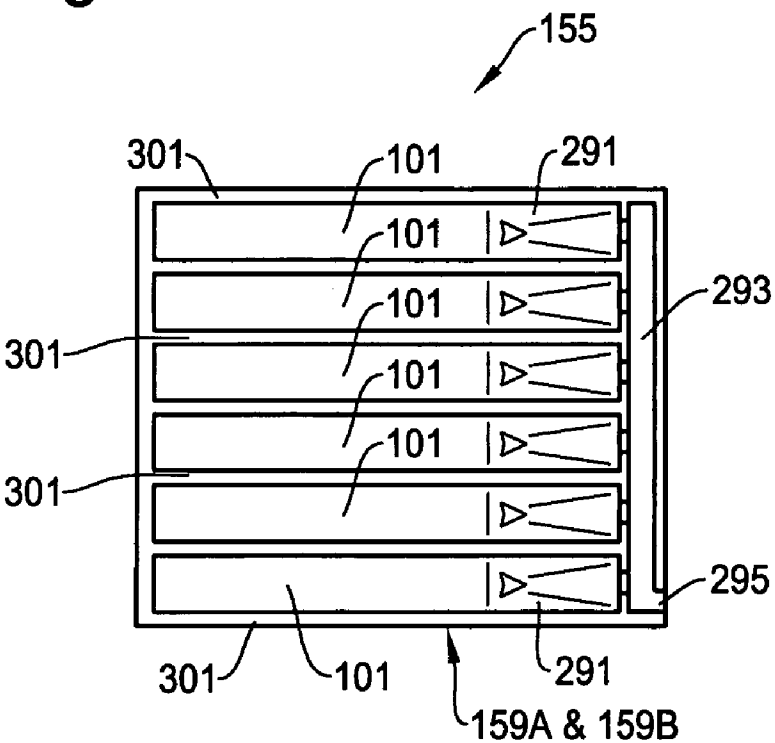

FIGS. 7A-7B and 8A-8C are schematic diagrams showing another example of structure of the air-packing device 201 of the present invention. FIG. 7A is a schematic plan view of the pocket portion 155 which are configured by two pocket portion sheets 159A and 159B having the same structure. FIG. 7B is a schematic front view of the pocket portion 155 with the two pocket sheets 159A and 159B of the same structure in parallel. The difference in the pocket portion 155 of FIGS. 7A and 7B compared with the one shown in FIG. 6B is that each pocket portion sheet 159 of the pocket portion 155 shown in FIG. 7 is almost half of that of FIG. 6 in the length and has no heat-seal lands at the center for folding.

Figure 8A:
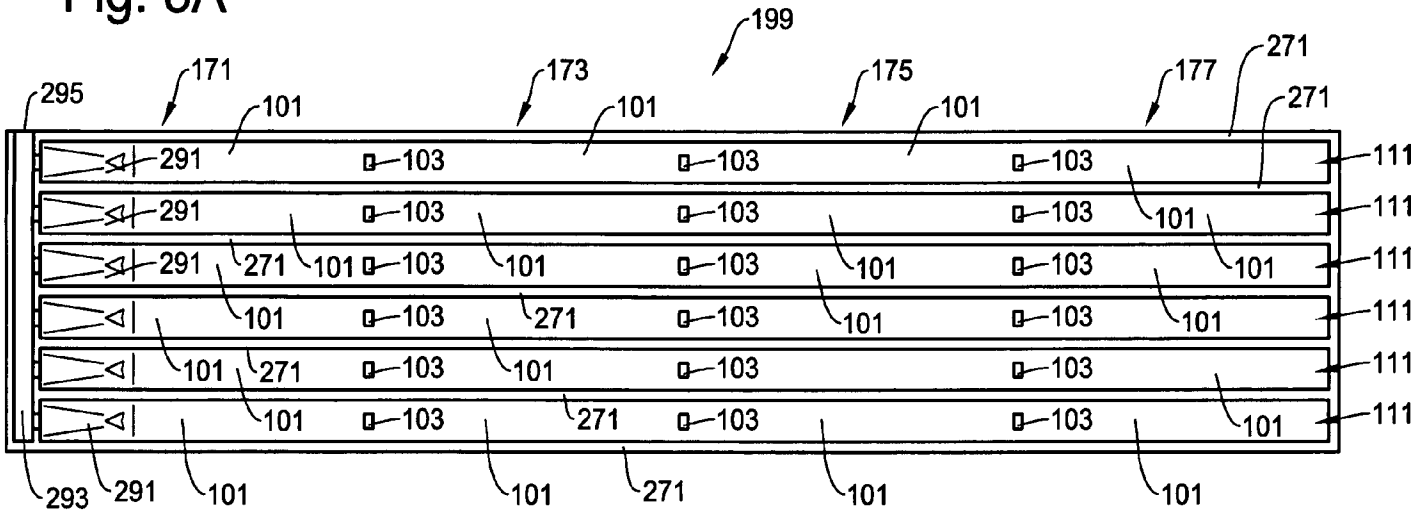
FIGS. 8A-8C are schematic views showing another example of sheet like structure of the enclosure portion and the pocket portion before being attached to one another for the air-packing device of the present invention.
Figure 8B:
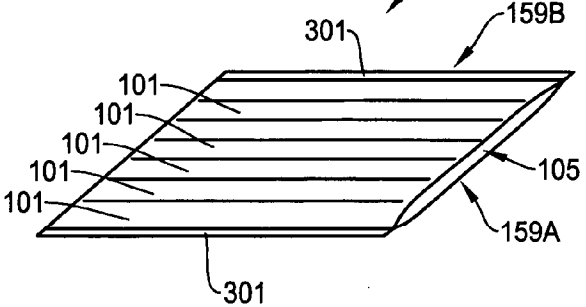
Figure 8C:
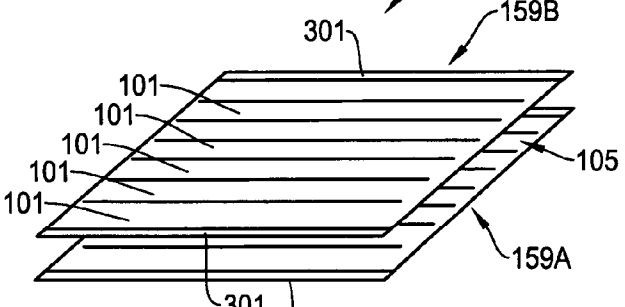

In order to form a pocket portion 155 with an opening, the two pocket portion sheets 159A and 159B shown in FIGS. 7A and 7B are used. The two pocket portion sheets 159A and 159B are attached to the enclosure portion 199 at about the intermediate position. FIG. 8A is a plan view showing the flat sheet of the enclosure portion 199. The edges (bonding areas 301) of the pocket portion sheets 159A and 159B may be bonded together as shown in FIG. 8B for being attached to the enclosure portion 199. Alternatively, each sheet 159 may be separated as shown in FIG. 8C and attached to the separation seal (bonding areas) 271 of the enclosure portion 199 at the different vertical level. Typically, the side edge portions 301 of the pocket portion 155 (pocket sheets 159) are attached to the bonding areas (separation seals) 271 at the side portions 171 and 175 of the enclosure portion 199.

Figure 9:
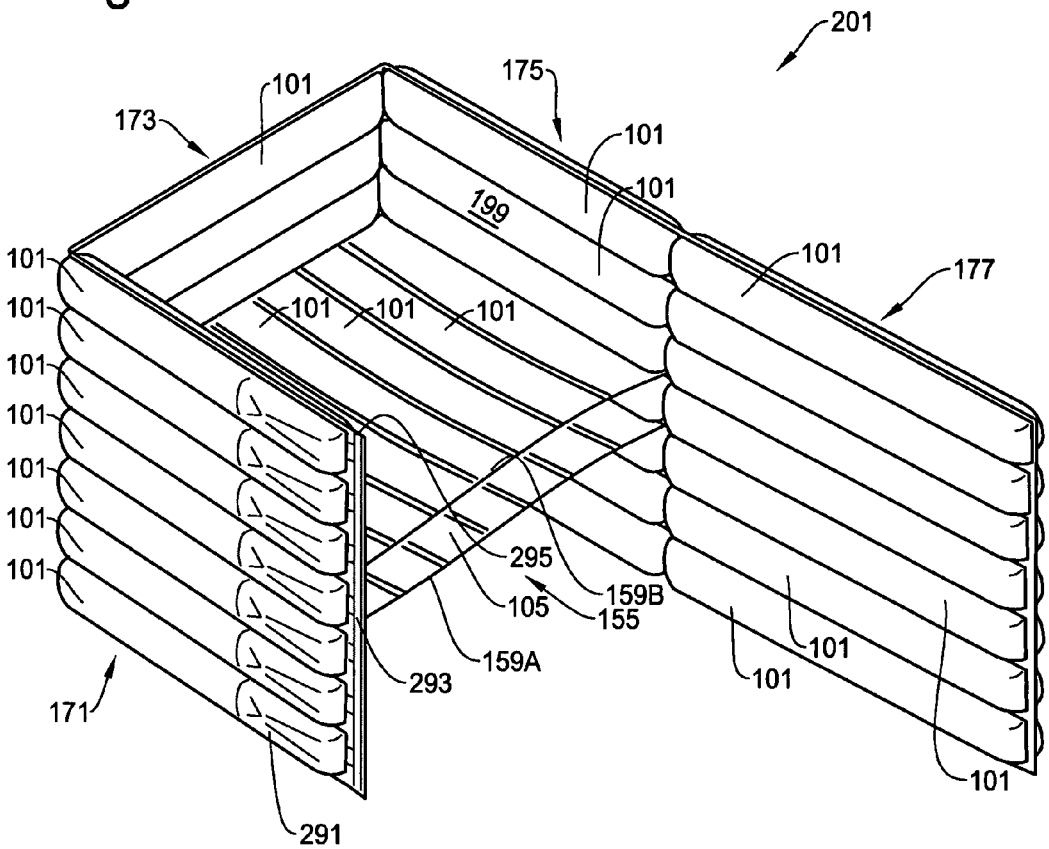
FIG. 9 is a perspective view showing a further example of the present invention in which the pocket portion is formed with an upper sheet and a lower sheet which are attached to different levels of the enclosure portion.
Figure 10:
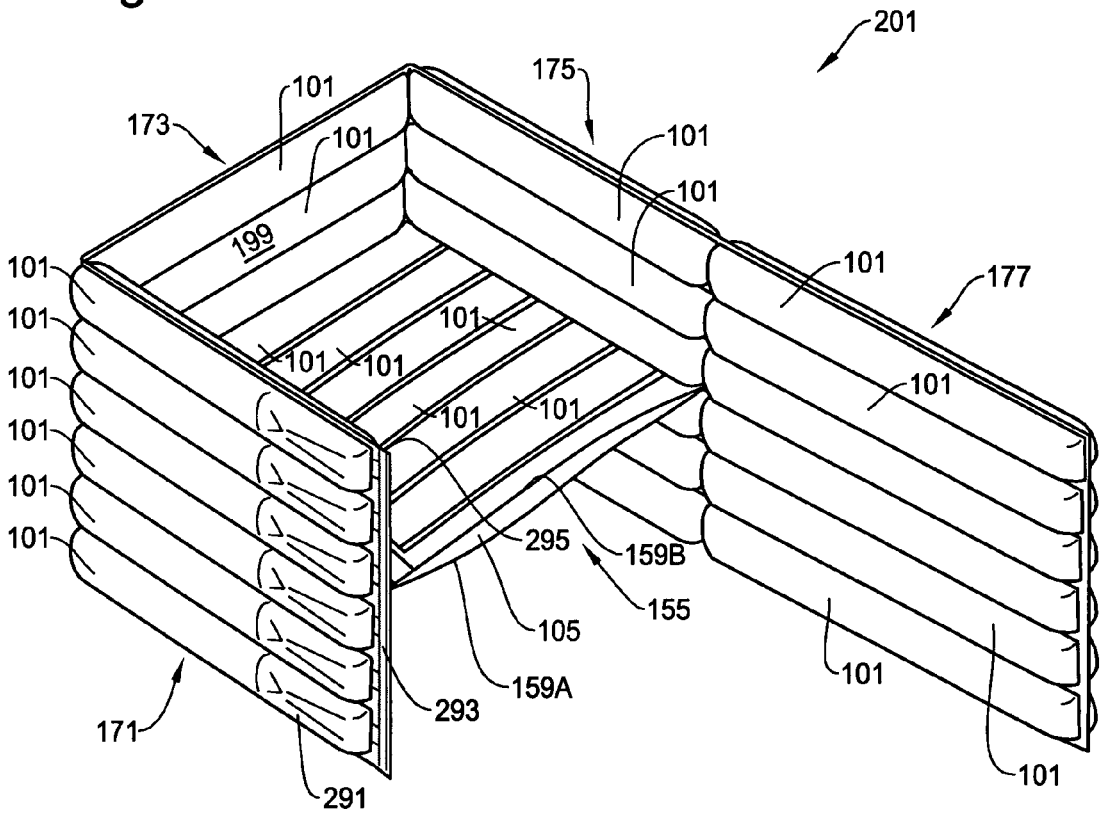
FIG. 10 is a perspective view showing a further example of the present invention where the air cells of the pocket portion is aligned in the direction different from that of FIGS. 3A-3E and FIG. 9.

Although preferred embodiments of the present invention have been described above, several other variations in accordance with the present invention are possible. FIGS. 9 and 10 are perspective views showing other embodiments of the air-packing device 201 of the present invention. Referring to FIG. 9, the alternative example is shown wherein the edges of the pocket portion 155 are connected to the seal portions at different rows of the enclosure portion 199. As shown, the opening becomes larger than that of the air-packing device 201 shown in FIGS. 3B-3D. For example, it is possible to increase the space between the pocket sheets by the size of one air cell or the number of air cells of the enclosure portion 199. The upper pocket sheet 159B is attached to the separation seal 271 that is higher by one or more air cells than the separation seal 271 to which the lower pocket sheet 159A is attached.

FIG. 10 is a perspective view of an alternative embodiment of the air-packing device 201 of the present invention. This configuration is similar to the one shown in FIGS. 3A-3F except that the orientation of the air cells of the pocket portion 155 is altered. Namely, in FIG. 10, the air cell 101 of the pocket portion sheets 159A and 159B are oriented in the right and left direction rather than in the front and back direction as in FIGS. 3A-3F. Although each of the pocket portion sheets 159A and 159B has check valves, such check valves are not shown in FIG. 10.

Figure 11A:
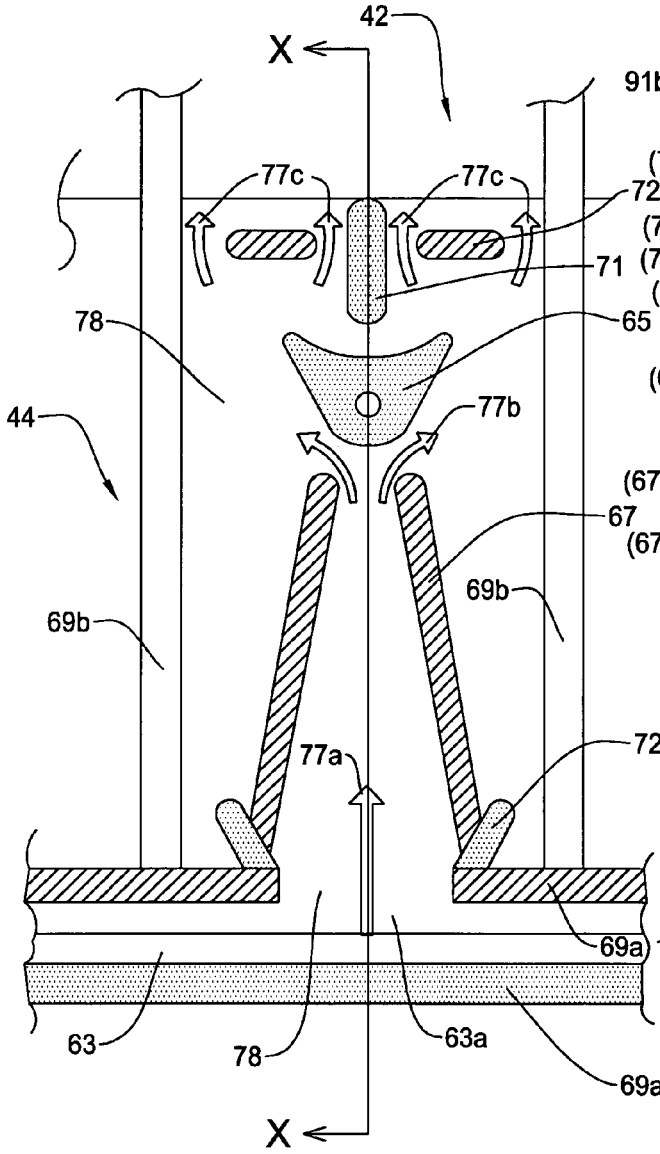
FIGS. 11A-11C are diagrams showing an example of detailed structure and operation of the check-valve in the present invention where
Figure 11B:
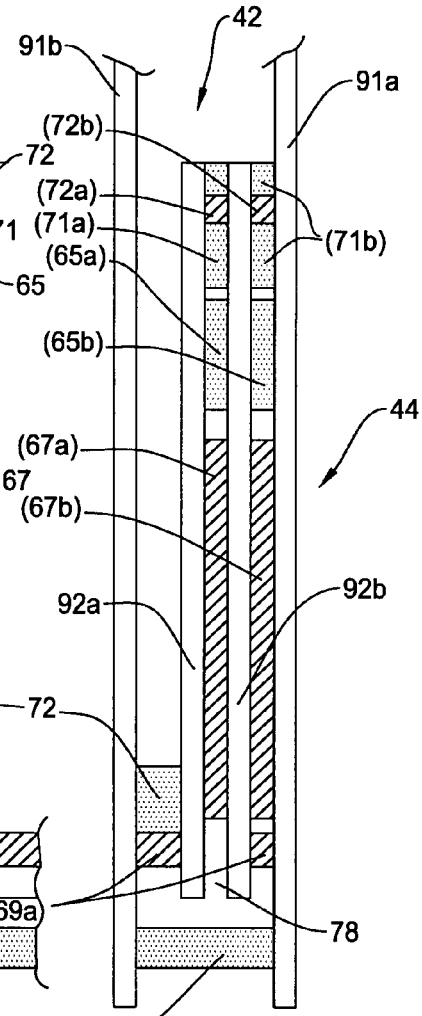
Figure 11C:
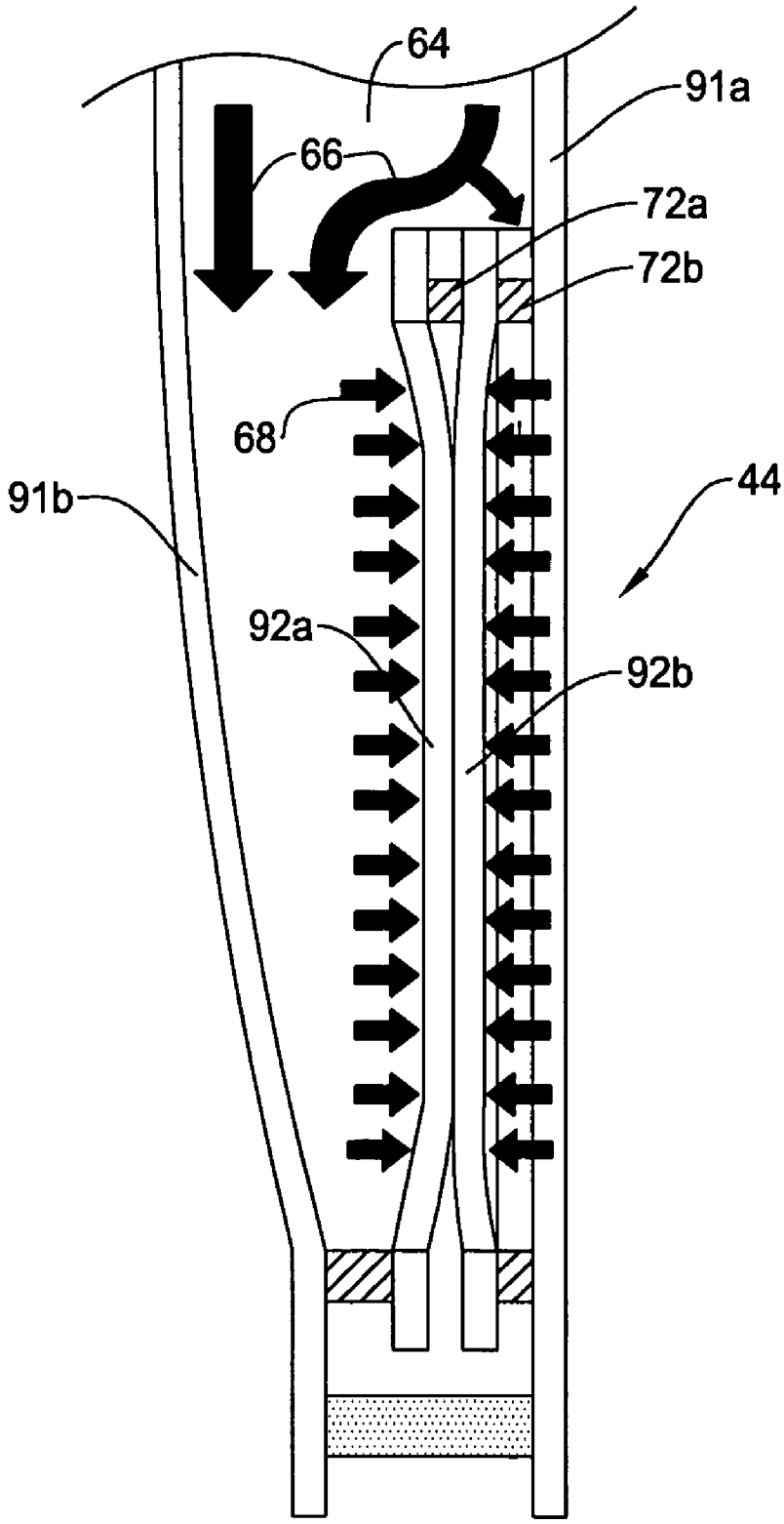

FIGS. 11A-11C show, in more detail, an example of structure of a check valve that are implemented in the present invention. In FIGS. 11A-11C, the check valve is denoted by reference numeral 44 and is equivalent to the check valves 291 shown in FIGS. 3-10. FIG. 11A is a top view of the check valve 44, FIG. 11B is a cross sectional side view of the check valve 44 taken along the line X-X in FIG. 11A when the compressed air is not supplied to the air-packing device, and FIG. 11C is a cross sectional side view of the check valve 44 when the compressed air is supplied to the air-packing device.

In the example of FIGS. 11A and 11B, reinforcing seal portions 72 are formed near a check valve inlet 63*a*. These portions are placed in a manner of contacting each edge of the inlet portion 63*a*. The seal portions 72 are provided to reinforce a boundary between the guide passage 63 and the air container (air cells 42) so as to prevent the air container from a rupture when it is inflated. In the check valve 44 of the present invention, the reinforcing seal portions 72 are preferable but not essential and thus can be omitted.

In the air-packing device 201, the two check valve films 92*a* and 92*b* are juxtaposed (superposed) and sandwiched between the two air-packing films 91*a* and 91*b* near the guide passage 63, and fixing seal portions 71-72, 65 and 67. The fixing seal portions 71-72 are referred to as outlet portions, the fixing seal portion 65 is referred to as an extended (or widened) portion, and the fixing seal portion 67 is referred to as a narrow down portion. These fixing seal portions also form the structure of the check valve 44, and fix the valve to the first air-packing film 91*a* at the same time. The fixing seal portions 65 are made by fusing the check valve films 92*a* and 92*b* only with the first air-packing film 91*a*.

The check valve 44 is made of the two check valve films (thermoplastic films) 92*a*-92*b* by which an air pipe (passage) 78 is created therebetween. How the air passes through the check valve 44 is shown by arrows denoted by the reference numbers 77*a*, 77*b* and 77*c* in FIG. 10A. The compressed air is supplied from the guide passage 63 through the air pipe 78 to the air container (air cells 42).

In the check valve 44, the regular air relatively easily flows through the air pipe 78 although there exist the fixing seal portions 65, 67 and 71-72. However, the reverse flow of the air in the valve will not pass through the air pipe 78. In other words, if the reverse flow occurs in the air pipe 78, it is prevented because of a pressure of the reverse flow itself. By this pressure, the two surfaces of check valve films 92*a* and 92*b* which face each other, are brought into tight contact as shown in FIG. 11 as will be explained later.

As has been described, in FIGS. 11A-11B, the fixing seal portions 65, 67 and 71-72 also work for guiding the air to flow in the check valve 44. The fixing seal portions are comprised of the portions 71*a*, 72*a*, 65*a* and 67*a* which bond the two check-valve films 92*a* and 92*b* together, and the portions 71*b*, 72*b*, 65*b* and 67*b* which bond the first air-packing film 91*a* and the first check valve film 92*b* together. Accordingly, the air pipe 78 in the check valve 44 is created as a passage formed between the two check valve films 92*a*-92*b*.

Further in FIG. 11A, the fixing seal portions 67 are composed of two symmetric line segments extended in an upward direction of the drawing, and a width of the air pipe 78 is narrowed down by the fixing seal portions (narrow down portions) 67. In other words, the regular flow can easily pass through the air pipe 78 to the air cell 42 when passing through the wide space to the narrow space created by the narrow down portions 67. On the other hand, the narrow down potions 67 tend to interfere the reverse flow from the air cells 42 when the air goes back through the narrow space created by the narrow down portions 67.

The extended portion 65 is formed next to the narrow down portions 67. The shape of the extended portion 65 is similar to a heart shape to make the air flow divert. By passing the air through the extended portion 65, the air diverts, and the air flows around the edge of the extended portion 65 (indicated by the arrow 77*b*). When the air flows toward the air cells 42 (forward flow), the air flows naturally in the extended portion 65. On the other hand, the reverse flow cannot directly flow through the narrow down portions 67 because the reverse flow hits the extended portion 65 and is diverted its direction. Therefore, the extended portion 65 also functions to interfere the reverse flow of the air.

The outlet portions 71-72 are formed next to the extended portion 65. In this example, the outlet portion 71 is formed at the upper center of the check valve 44 in the flow direction of the air, and the two outlet portions 72 extended to the direction perpendicular to the outlet portion 71 are formed symmetrically. There are several spaces among these outlet portions 71 and 72. These spaces constitute a part of the air pipe 78 through which the air can pass as indicated by the arrows 77*c*. The outlet portions 71-72 are formed as a final passing portion of the check valve 44 when the air is supplied to the air container (air cells 42) and the air diverts in four ways by passing through the outlet portions 71-72.

As has been described, the flows of air from the guide passage 63 to the air cells 42 is relatively smoothly propagated through the check valve 44. Further, the narrow down portions 67, extended portions 65 and outlet portions 71-72 formed in the check valve 44 work to interfere the reverse flow of the air. Accordingly, the reverse flow from the air cells 42 cannot easily pass through the air pipe 78, which promotes the process of supplying the air in the air-packing device.

FIG. 11C is a cross sectional view showing an effect of the check valve 44 of the present invention. This example shows an inner condition of the check valve 44 when the reverse flow tries to occur in the air-packing device when it is sufficiently inflated. First, the air can hardly enter the air pipe 78 because the outlet portions 71 and 72 work against the air such that the reverse flow will not easily enter in the outlet portions. Instead, the air flows in a space between the second air-packing film 91*b* and the second check valve film 92*a* as indicated by the arrows 66, and the space is inflated as shown in FIG. 11C. By this expansion, in FIG. 11C, the second check valve film 92*a* is pressed to the right, and at the same time, the first check valve film 92*b* is pressed to the left. As a result, the two check valve films 92*a* and 92*b* are brought into tight contact as indicated with the arrows 68. Thus, the reverse flow is completely prevented.

Figure 12A:
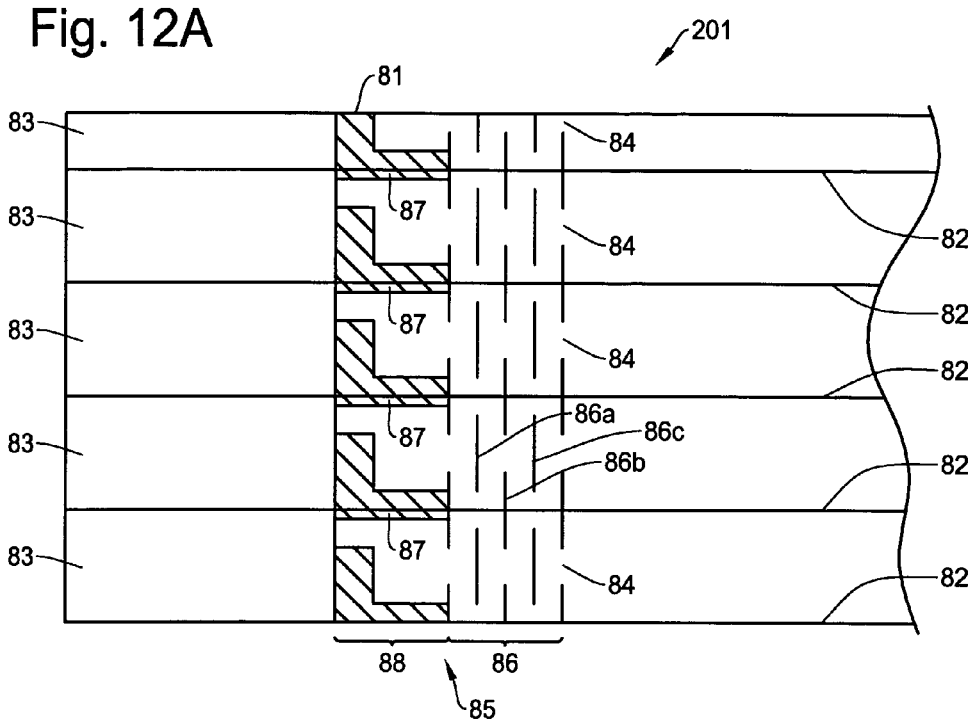
FIGS. 12A-12D show another example of check valve of the present invention where

Another example of the check valve of the present invention is described in detail with reference to FIGS. 12A-12D, 13-14 and 15A-15B in which a check valve is denoted by a reference numeral 85. FIGS. 12A-12D are plan views of the check valve used in the air-packing devices 201 of the present invention. FIG. 12A shows a structure of a check valve 85 and a portion of the air-packing device 201. The air-packing device 201 having the check valves 85 is comprised of two or more rows of air container each having serially connected air cells 83 which are equivalent to the air cells 101 in FIGS. 3-10. As noted above, typically, each row of air container has a plurality of series connected air cells 83 although only one air cell is illustrated in FIG. 12A.

Before supplying the air, the air-packing device 201 is in a form of an elongated rectangular sheet made of a first (upper) thermoplastic film 93 and a second (lower) thermoplastic film 94. To create such a structure, each set of series air cells are formed by bonding the first thermoplastic film (air packing film) 93 and the second thermoplastic film (air packing film) 94 by the separation seal (bonding area) 82. Consequently, the air cells 83 are created so that each set of series connected air cells can be independently filled with the air.

Figure 12B:
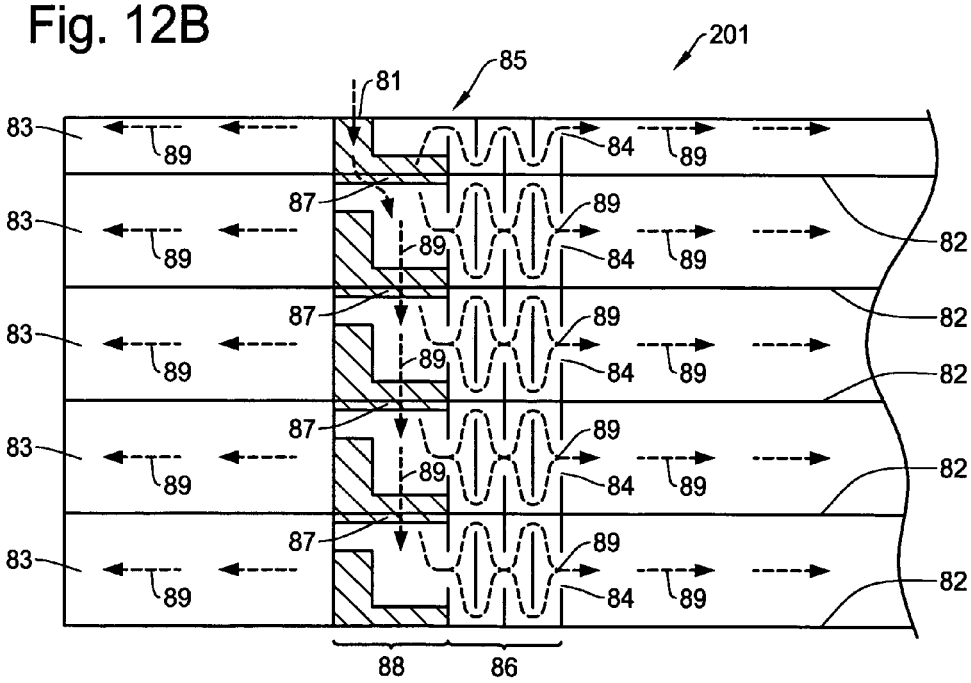
Figure 12C:
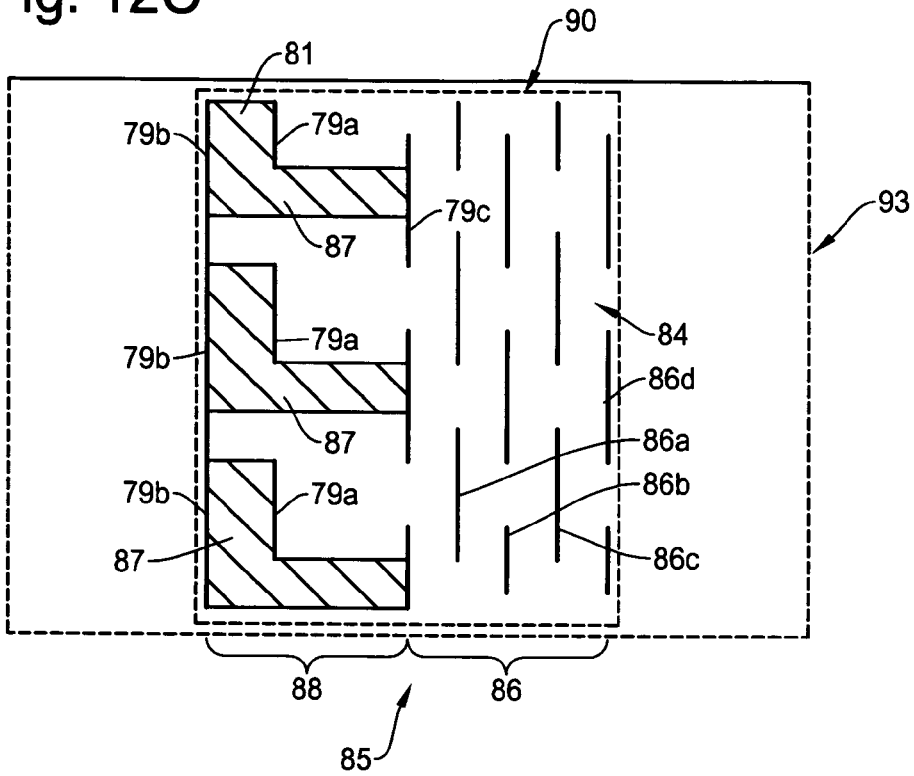

A check valve film 90 having a plurality of check valves 85 is attached to one of the thermoplastic films 93 and 94 as shown in FIG. 12C. When attaching the check valve film 90, peeling agents 87 are applied to the predetermined locations on the separation seals 82 between the check valve film 90 and one of the thermoplastic films 93 and 94. The peeling agent 87 is a type of paint having high thermal resistance so that it prohibits the thermal bonding between the first and second thermoplastic films 93 and 94. Accordingly, even when the heat is applied to bond the first and second thermoplastic films 93 and 94 along the separation seal 82, the first and second thermoplastic films 93 and 94 will not adhere with each other at the location of the peeling agent 87.

The peeling agent 87 also allows the air input 81 to open easily when filling the air in the air-packing device 201. When the upper and lower films 93 and 94 made of identical material are layered together, there is a tendency that both films stick to one another. The peeling agent 87 printed on the thermoplastic films prevents such sticking. Thus, it facilitates easy insertion of an air nozzle of the air compressor into the air inlet 81 when inflating the air-packing device.

The check valve 85 of the present invention is configured by a common air duct portion 88 and an air flow maze portion 86. The air duct portion 88 acts as a duct to allow the flows of the air from the air port 81 to each set of air cells 83. The air flow maze portion 86 prevents free flow of air between the air-packing device 201 and the outside, i.e., it works as a brake against the air flows, which makes the air supply operation easy. To achieve this brake function, the air flow maze portion 86 is configured by two or more walls (heat-seals) 86*a*-86*c*. Because of this structure, the air from the common air duct portion 88 will not straightly or freely flow into the air cells 83 but have to flow in a zigzag manner. At the and of the air flow maze portion 86, an exit 84 is formed.

In the air-packing device 201 incorporating the check valve 85 of the present invention, the compressed air supplied to the air input 81 to inflate the air cells 83 flows in a manner as illustrated in FIG. 12B. The plan view shown in FIG. 12B includes the structure of the check valve 85 identical to that of FIG. 12A and further includes dotted arrows 89 showing the flows of the air in the check valve 85 and the air cells 83. As indicated by the arrows 89, the air from the check valve 85 flows both forward direction and backward direction of the air-packing device 201. Thus, the check valve 85 can be formed at any locations of the air-packing device 201. Further, the check valve 85 requires a relatively low pressure of the air compressor when it is attached to an intermediate location of the air-packing device 201.

In FIG. 12B, when the air is supplied to the air input 81 from the air compressor (not shown), the air flows toward the exit 84 via air duct portion 88 and the air flow maze portion 86 as well as toward the next adjacent air cell 83 via the air duct portion 88. The air exited from the exit 84 inflates the air cell 83 by flowing both forward and backward directions (right and left directions of FIG. 12B) of the air-packing device 201. The air transferred to the next air cell flows in the same manner, i.e., toward the exit 84 and toward the next adjacent air cell 83. Such operations continue from the first air cell 83 to the last air cell 83. In other words, the air duct portion 88 allows the air to flow to either the present air cell 83 through the air flow maze portion 86 and to the next air cell 83.

Figure 12D:
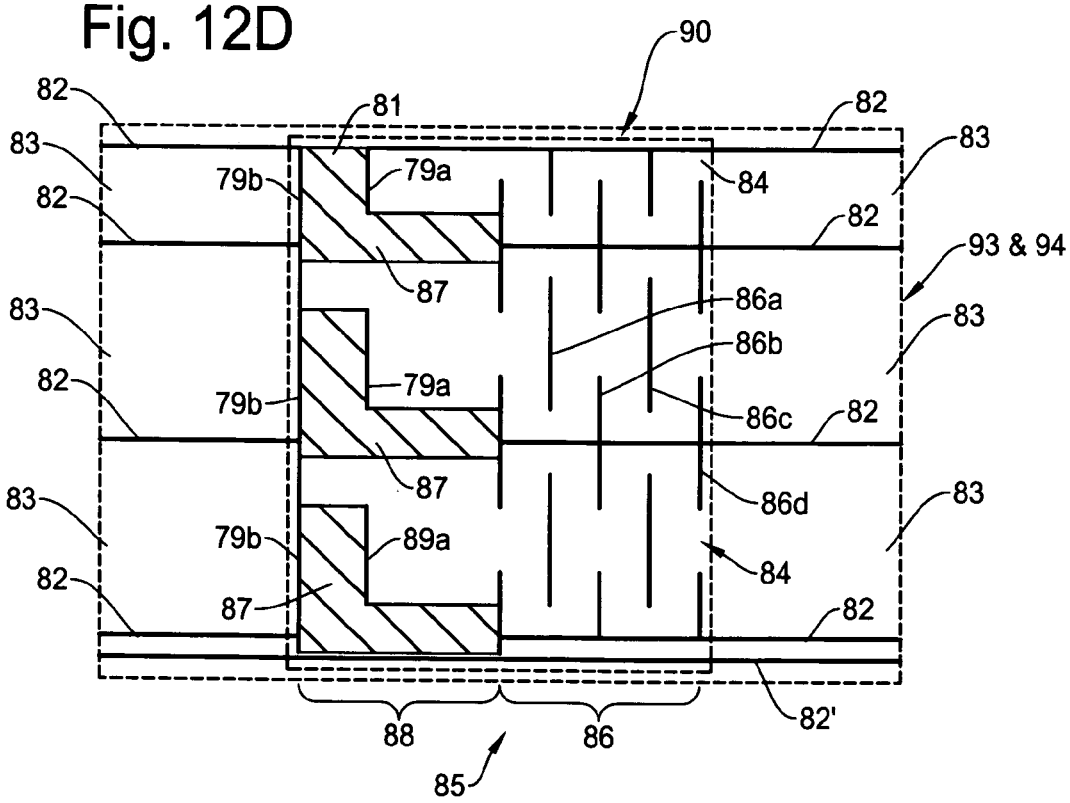

FIGS. 12C-12D show an enlarged view of the check valve of the present invention for explaining how the check valves 85 are created on the air-packing device. As noted above, the check valve film 90 is attached to either one of the thermoplastic film 93 or 94. The example of FIGS. 12C and 12D show the case where the check valve film 90 is attached to the upper (first) thermoplastic film 93. The thick lines in the drawings indicate the heat-seal (bonding) between the thermoplastic films.

The air-packing device of the present invention is manufactured by bonding the second (lower) thermoplastic film 94, the check valve film 90, and the first (upper) thermoplastic film 93 by pressing the films with a heater. Since each film is made of thermoplastic material, they will bond (welded) together when the heat is applied. In this example, the check valve film 90 is attached to the upper thermoplastic film 93, and then, the check valve film 90 and the upper thermoplastic film 93 are bonded to the lower thermoplastic film 94.

First, as shown in FIG. 12C, the check valve film 90 is attached to the upper thermoplastic film 93 by heat-sealing the two films at the portions indicated by the thick lines. Through this process, the peeling agents 87 applied in advance to the check valve film 90 is attached to the upper thermoplastic film 93 by the bonding lines 79*a* and 79*b* to create the air duct portions 88. Further, the air flow maze portions 86 are created by the bonding lines 86*a*-86*c*, etc. At the end of the maze portion 86 is opened to establish the air exit 84.

Then, as shown in FIG. 12D, the check valve film 90 and the upper thermoplastic film 93 are attached to the lower thermoplastic film 94 by heat-sealing the upper and lower films at the portions indicated by the thick lines 82. Through this process, each air cell 83 is separated from one another because the boundary between the two air cells is closed by the sealing line (boundary line) 82. However, the range of the sealing line 82 having the peeling agent 87 is not closed because the peeling agent prohibits the heat-sealing between the films. As a result, the air duct portion 88 is created which allows the air to flow in the manner shown in FIG. 12B.

Figure 13:
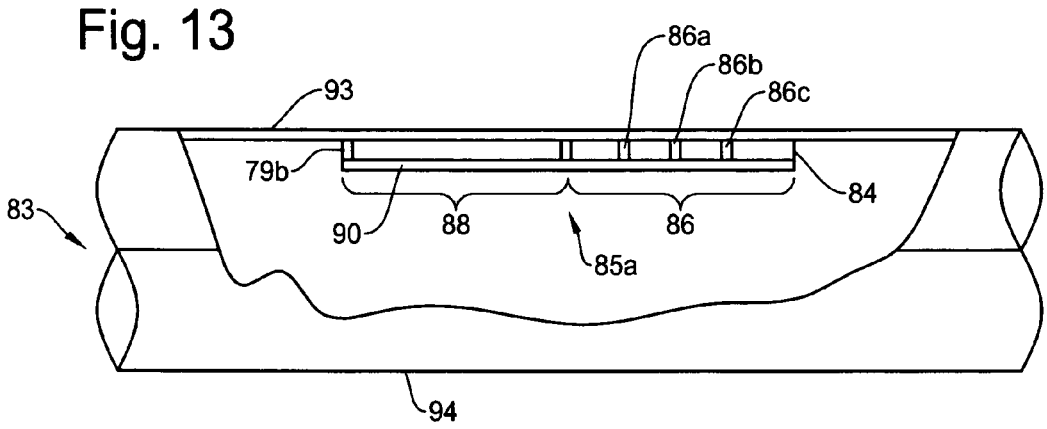
FIG. 13 is a cross sectional view showing an example of inner structure of the check valve in the present invention configured by a single layer film and formed on one of the thermoplastic films of the air-packing device.

FIG. 13 is a partial cross sectional front view showing an example of inner structure of the check valve 85*a* of the present invention configured by a single layer film and formed on a thermoplastic film of the air-packing device. As described in the foregoing, the common air duct portion 88 and the air flow maze portion 86 are created between the check valve film 90 and one of the upper and lower thermoplastic films 93 and 94. In this example, the check valve film 90 is attached to the upper thermoplastic film 93 through the heat-sealing in the manner described with reference to FIG. 12C.

The air flow maze portion 86 has a maze structure such as a zig-zaged air passage to cause resistance to the air flow such as reverse flow. Such a zig-zaged air passage is created by the bonding (heat-sealed) lines 86*a*-86*c*. Unlike the straight forward air passage, the maze portion 86 achieves an easy operation for inflating the air-packing device by the compressed air. Various ways for producing the resistance of the air flow are possible, and the structure of the maze portion 86 shown in FIGS. 12A-12D and 13 is merely one example. In general, the more complex the maze structure, the less area of the maze portion 86 is necessary to adequately produce the resistance against the air flow.

Figure 14:
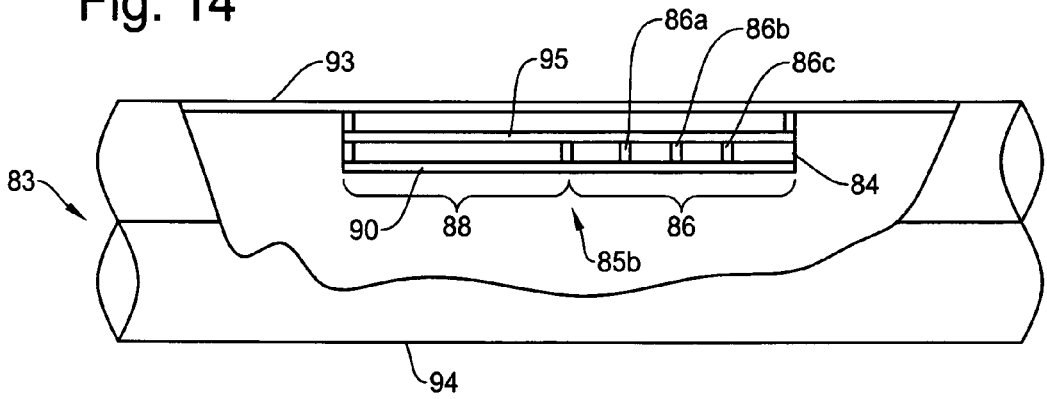
FIG. 14 is a cross sectional view showing another example of the inner structure of the check valve in the present invention configured by double layer films and formed on one of the thermoplastic films of the air-packing device.

FIG. 14 is a cross sectional view showing another example of the inner structure of the check valve 85*b* in the present invention configured by double layer films and formed on one of the thermoplastic films of the air-packing device. In this example, an addition film 95 is provided between the upper thermoplastic film 93 and the check valve film 90. The additional film 95 and the check valve film 90 forms the check valves 85*b*. The additional film 95 is so attached to the upper thermoplastic film 93 that the space between the upper thermoplastic film 93 and the additional film 95 will not transmit air.

The advantage of this structure is the improved reliability in preventing the reverse flows of air. Namely, in the check valve of FIG. 13, when the air is filled in the air cell 83, the upper thermoplastic film 93 of the air cell having the check valve 85 is curved. Further, when a product is loaded in the air-packing device, the surface projection of the product may contact and deform the outer surface of the air cell having the check valve therein. The sealing effect created by the check valve can be weakened because of the curvature of the air cell. The additional film 95 in FIG. 14 mitigates this problem since the film 95 is independent from the upper thermoplastic film 93.

Figure 15A:
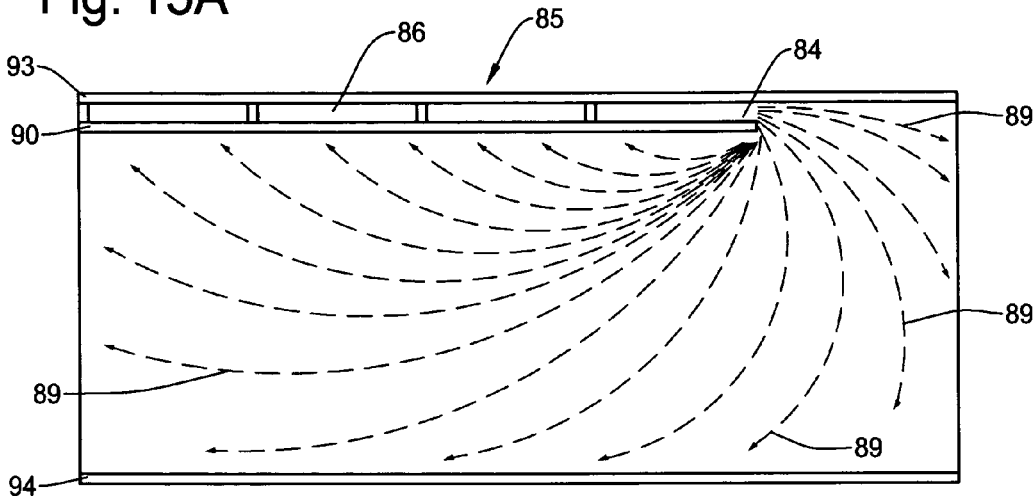
FIGS. 15A and 15B are cross sectional views showing the inner structure of a check valve of the present invention where
Figure 15B:
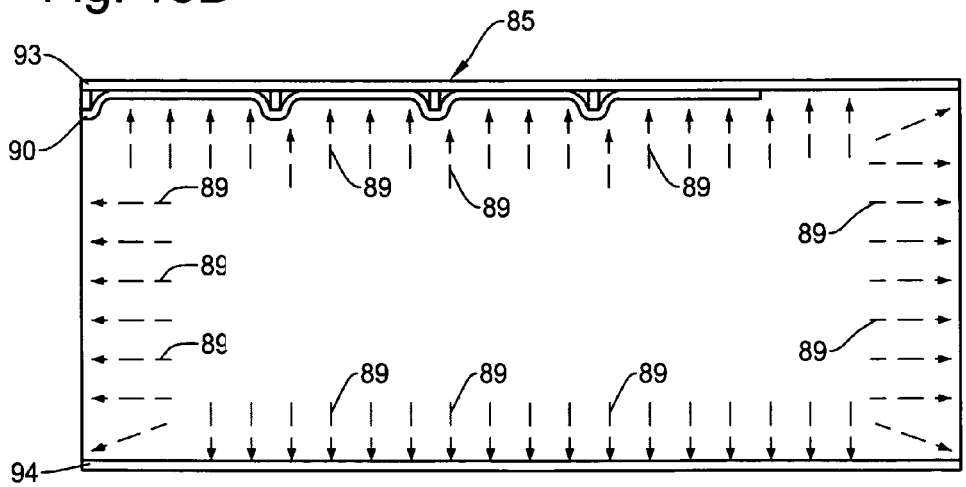

FIGS. 15A and 15B are cross section views showing the inside of the air cell having the check valve 85. FIG. 15A shows the condition wherein the compressed air is being introduced into the air-packing device through the check valve 85. FIG. 15B shows the condition where the air-packing device is filled with air to an appropriate degree so that the check valve 85 is operated to effectively close by the inside air pressure. The dotted arrows 89 indicate the flow of air in FIGS. 15A and 15B.

As shown in FIG. 15A, when the air is pumped in from the air input 81 (FIGS. 12A-12B), the air will flow toward each air cell. While a part of the air flows toward the next row of air cells, the remaining air goes into the present air cell to inflate the air cell. The air will flow into the air cell due to the pressure applied from the air source such as an air compressor. The air goes through the air flow maze portion 86 and exits from the exit 84 at the end of the maze portion 86. All of the air cells will eventually be filled with the compressed air.

As shown in FIG. 15B, when the air cell having the check valve 85 is inflated to a certain extent, the inner pressure of the air will push the check valve film 90 upward so that it touches the upper thermoplastic film 93. FIG. 15B mainly shows the air flow maze portion 86 of the check valve 85 to show how the check valve 85 works. When the inner pressure reaches a sufficient level, the check valve film 90 air-tightly touches the upper thermoplastic film 93, i.e., the check valve 85 is closed, thereby preventing the reverse flows of the air.

As has been described above, according to the present invention, the air-packing device can minimize shocks or vibrations to the product when the product is dropped or collided. The sheet form of the air-packing device is folded and the post heat-seal treatment is applied thereto, thereby creating a structure unique to a production to be protected. The air-packing device is basically configured by the enclosure portion and the pocket portion. The enclosure portion is comprised of multiple rows of air containers. The pocket portion is formed at about the center of the enclosure portion. Consequently, even when a large shock or vibration is applied to the air-packing device, the pocket portion will not touch the ground. Further, since the pocket portion is flexibly moved when the shock is applied, it can effectively damp the shock to the product therein. The check valves in the air-packing device have a unique structure for preventing reverse flows of the air. The air-packing device of the present invention has a relatively simple structure with reliable check valves, thus, the present invention is able to provide a reliable air-packing device with low cost.

Although the invention is described herein with reference to the preferred embodiments, one skilled in the art will readily appreciate that various modifications and variations may be made without departing from the spirit and the scope of the present invention. Such modifications and variations are considered to be within the purview and scope of the appended claims and their equivalents.

What is claimed is:

1. An air-packing device for protecting a product therein when stored in a container box, comprising:

a pocket portion having an upper sheet portion and a lower sheet portion to create an opening into which said product is inserted, each of said upper sheet portion and said lower sheet portion having a plurality of air containers;

an enclosure portion having a plurality of air containers and configuring walls that surround said pocket portion therein;

wherein said pocket portion is supported by said enclosure portion at about an intermediate height of said enclosure portion such that said product in said pocket portion will not contact with a bottom or top of the container box when shocks are applied to the air-packing device; and wherein each of said air containers of said pocket portion and said enclosure portion has a check valve for allowing air to flow in a forward direction while preventing the air from flowing in a reverse direction.

2. An air-packing device, as defined in claim 1, wherein each air container of said enclosure portion has a multiplicity of air cells serially connected with one another thereby allowing the air to flow through the air cells of the same air container.

3. An air-packing device, as defined in claim 2, wherein each air cell is separated from the other air cells on the same air container by a heat-seal land at which thermoplastic films forming the air-packing device are heat-sealed, and wherein the air flows through a passage created on a side of the heat-seal land toward the next air cell on the same air container.

4. An air-packing device, as defined in claim 2, wherein each air cell is separated from the other air cells on the same air container by a heat-seal land at which thermoplastic films forming the air-packing device are heat-sealed, and wherein the heat-seal lands on the air container function as folding points of the walls of the enclosure portion.

5. An air-packing device as defined in claim 1, wherein said walls are configured by four side walls so that the enclosure portion has a box-like shape.

6. An air-packing device as defined in claim 1, wherein each of said pocket portion and said enclosure portion is comprised of first and second thermoplastic films superposed with each other where predetermined portions of the first and second thermoplastic films are bonded, thereby creating the plurality of air containers, and wherein said check valves are established between the first and second thermoplastic films.

7. An air-packing device as defined in claim 1, further comprising an air input commonly connected to the plurality of check valves to supply the compressed air to all of the air container.

8. An air-packing device as defined in claim 1, wherein at least two side edges of said pocket portion are attached to said enclosure portion in such a manner that each side edge is heat-sealed to an area which is a boundary between two adjacent air containers of the enclosure portion through a post heat-seal treatment.

9. An air-packing device as defined in claim 1, wherein edges of an upper sheet portion of said pocket portion are attached to said enclosure portion where each edge is heat-sealed to an area between two adjacent air containers, and edges of a lower sheet portion of said pocket portion are attached to said enclosure portion where each edge is heat-sealed to the same area between two air containers where the corresponding edge of the upper sheet portion is attached.

10. An air-packing device as defined in claim 1, wherein edges of an upper sheet portion of said pocket portion are attached to said enclosure portion where each edge is heat-sealed to an area between two adjacent air containers, and edges of a lower sheet portion of said pocket portion are attached to said enclosure portion where each edge is heat-sealed to an area between two air containers which is vertically different from the area where the corresponding edge of the upper sheet portion is attached.

11. An air-packing device as defined in claim 1, wherein one wall of said enclosure portion is a door wall that is designed to bend so that the door wall allows to insert said product in said pocket portion through the opening of said pocket portion.

12. An air-packing device as defined in claim 1, wherein said check valve includes sealed portions which are fixed to one of thermoplastic films configuring the air-packing device, wherein the sealed portions include:

an inlet portion which introduces the air into the check valve;

a pair of narrow down portions creating a narrow down passage connected to the inlet portion;

an extended portion which diverts the air flows coming through the narrow down passage; and a plurality of outlet portions which introduce the air from the extended portion to the air container.

13. An air-packing device as defined in claim 12, wherein reinforcing seal portions are formed close to the inlet portion to reinforce the bonding between the check valve and one of the first and second thermoplastic films.

14. An air-packing device as defined in claim 1, wherein the check valve is comprised of:

a check valve film on which peeling agents of predetermined pattern are printed, said check valve film being attached to one of first and second thermoplastic films configuring the air-packing device;

an air input established by one of the peeling agents on the air-packing device for receiving an air from an air source;

an air flow maze portion forming an air passage of a zig-zag shape, said air flow maze portion having an exit at an end thereof for supplying the air from the air passage to a corresponding air container having one or more series connected air cells; and a common air duct portion which provides the air from the air input to the air flow maze portion of a current air container as well as to the air flow maze portion of a next air container having one or more series connected air cells;

wherein heat-sealing between the first and second thermoplastic films for separating two adjacent air containers is prevented in a range where said peeling agent is printed.

15. An air-packing device as defined in claim 14, wherein said check valves are formed at any desired position on the air-packing device where the air from the check valve flows in both forward and backward directions in the air container to fill all of the series connected air cells therein.

16. An air-packing device as defined in claim 14, wherein an additional film is provided between the check valve film and one of said first and second thermoplastic films.

17. An air-packing device as defined in claim 14, wherein the check valve film is attached to one of said first and second thermoplastic films at any desired locations of the air-packing device.

18. An air-packing device as defined in claim 14, wherein at least the air passage in said air flow maze portion is closed by air tightly contacting the check valve film with one of said first and second thermoplastic films by the air pressure within the air cell when the air-packing device is filled with the compressed air to a sufficient degree.

19. An air-packing device as defined in claim 18, wherein at least the air passage in said air flow maze portion is closed by air tightly contacting the check valve film with said additional film by the air pressure within the air cell when the air-packing device is filled with the compressed air in a sufficient level.

* * * * *